US006366014B1

(12) United States Patent
Kuroda et al.

(10) Patent No.: US 6,366,014 B1
(45) Date of Patent: Apr. 2, 2002

(54) CHARGE-UP SUPPRESSING MEMBER, CHARGE-UP SUPPRESSING FILM, ELECTRON BEAM APPARATUS, AND IMAGE FORMING APPARATUS

(75) Inventors: Kazuo Kuroda, Atsugi; Hiroshi Takagi; Takao Kusaka, both of Yokohama; Hiromitsu Takase, Sagamihara; Noriaki Ohguri, Zama, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/234,407

(22) Filed: Jan. 21, 1999

Related U.S. Application Data

(63) Continuation-in-part of application No. 09/127,586, filed on Aug. 3, 1998, now Pat. No. 6,265,822, and a continuation-in-part of application No. 09/166,537, filed on Oct. 6, 1998, now abandoned.

(30) Foreign Application Priority Data

| | | |
|---|---|---|
| Aug. 1, 1997 | (JP) | 9-207726 |
| Jun. 9, 1998 | (JP) | 10-160818 |
| Jul. 17, 1998 | (JP) | 10-203416 |
| Jul. 17, 1998 | (JP) | 10-203417 |
| Jul. 31, 1998 | (JP) | 10-217784 |
| Oct. 2, 1998 | (JP) | 10-281243 |

(51) Int. Cl.[7] ..... H01J 19/10
(52) U.S. Cl. ..... 313/495; 313/497
(58) Field of Search ..... 313/495, 496, 313/497, 310, 309, 336, 351, 355, 512; 345/74; 445/52

(56) References Cited

U.S. PATENT DOCUMENTS 4,470,009 A 9/1984 Takayanagi et al. ..... 324/72
4,511,240 A 4/1985 Suzuki et al. ..... 355/14 R (List continued on next page.)

FOREIGN PATENT DOCUMENTS

| | | |
|---|---|---|
| EP | 0 725 420 | 8/1996 |
| EP | 0 851 458 | 7/1998 |
| JP | 57-118355 | 7/1982 |
| JP | 57-118356 | 7/1982 |
| JP | 61-124031 | 6/1986 |
| JP | 64-31332 | 2/1989 |
| JP | 2-257551 | 10/1990 |
| JP | 2-276670 | 11/1990 |
| JP | 3-49135 | 3/1991 |
| JP | 3-55738 | 3/1991 |
| JP | 4-28137 | 1/1992 |
| WO | WO 94/18694 | 8/1994 |

OTHER PUBLICATIONS

G. Dittmer, "Electrical Conduction and Electron Emission of Discontinuous Thin Films", Thin Solid Films, vol. 9, pp. 317–328 (1972).
M. I. Elinson, et al., "The Emission of Hot Electrons and the Field Emission of Electrons from Tin Oxide", Radio Engineering and Electronic Physics, No. 7., pp. 1290–1296 (Jul. 1965).
M. Hartwell, et al., "Strong Electron Emission from Patterned Tin–Indium Oxide Thin Films", International Electron Devices Meeting, pp. 519–521 (1975).

(List continued on next page.)

*Primary Examiner*—Ashok Patel
(74) *Attorney, Agent, or Firm*—Fitzpatrick, Cella, Harper & Scinto

(57) ABSTRACT

An electron beam apparatus includes an electron source and a radiative member on which electrons emitted from the electron source are radiated. In addition, a member is provided between the electron source and the radiative member, with the member having an electroconductive first member and a second member formed on the first member to partially exposed the first member.

16 Claims, 18 Drawing Sheets

U.S. PATENT DOCUMENTS

| | | | | | |
|---|---|---|---|---|---|
| 4,564,287 | A | | 1/1986 | Suzuki et al. | 355/14 D |
| 4,592,646 | A | | 6/1986 | Suzuki et al. | 355/14 R |
| 4,656,338 | A | | 4/1987 | Yagasaki et al. | 219/497 |
| 4,755,850 | A | | 7/1988 | Suzuki et al. | 355/14 D |
| 4,904,895 | A | | 2/1990 | Tsukamoto et al. | 313/336 |
| 5,066,833 | A | | 11/1991 | Zalenski | 178/19 |
| 5,066,883 | A | | 11/1991 | Yoshioka et al. | 313/309 |
| 5,760,538 | A | * | 6/1998 | Mitsutake et al. | 313/422 |
| 5,905,336 | A | * | 5/1999 | Van Hal et al. | 313/497 |
| 5,986,389 | A | * | 11/1999 | Tsukamoto | 313/495 |
| 6,013,980 | A | * | 1/2000 | Goel et al. | 313/495 |

OTHER PUBLICATIONS

H. Araki, et al., "Electroforming and Electron Emission of Carbon Thin Films", Journal of the Vacuum Society of Japan, vol. 26, No. 1, pp. 22–29 (1983).

W. P. Dyke, "Field Emission", Advances in Electronics and Electron Physics, vol. VII, pp. 89–185 (1956).

C. A. Spindt, "Physical Properties of Thin–Film Field Emission Cathodes with Molybdenum Cones", Journal of Applied Physics, vol. 47, No. 12, pp. 5248–5263 (Dec. 1976).

C. A. Mead, "Operation of Tunnel–Emission Devices", Journal of Applied Physics, vol. 32, No. 4, pp. 646–652 (Apr. 1961).

J. Cross, et al., "The Effect of Cuprous Oxide Coatings on Surface Flashover of Dielectric Spacers in Vacuum", IEEE Transactions on Electrical Insulation, vol. EI–9, No. 4, pp. 146–150 (Dec. 1974).

R. Meyer, "Recent Development on "Microtips" Display at LETI", Technical Digest of IVMC 91, pp. 6–9 (1991).

T. Sudarshan, "The Effect of Chromium Oxide Coatings on Surface Flashover of Alumina Spacers in Vacuum", IEEE Transactions of Electrical Insulation, vol. EI–11, No. 1, pp. 32–35 (Mar. 1976).

* cited by examiner

CHARGE-UP SUPPRESSING MEMBER, CHARGE-UP SUPPRESSING FILM, ELECTRON BEAM APPARATUS, AND IMAGE FORMING APPARATUS

This application is a continuation-in-part of U.S. patent application Ser. No. 09/127,586 filed on Aug. 3, 1998 now U.S. Pat. No. 6,265,822 and U.S. patent appaication Ser. No. 09/166,537 filed on Oct. 6, 1998 now abandoned.

BACKGROUND OF THE INVENTION

1. Field of the Invention

The present invention relates to a charge-up suppressing film being hard to be charged, having less charges, and/or being capable of rapidly suppressing charges, and to a member constituting the charge-up suppressing film. The invention also relates to an electron beam apparatus and an image forming apparatus using the member.

2. Related Background Art

Two types of electron-emitting devices are known which are roughly classified into a thermal electron-emitting device and a cold cathode electron-emitting device. The types of a cold cathode electron-emitting device include a surface conduction emitting type, a field emission type (hereinafter called an FE type), a metal/insulator/metal type (hereinafter called an MIM type), and the like.

Examples of the surface conduction electron-emitting device are disclosed in Radio Eng. Electron Phys., by M. I. Elinson, 10, 1290 (1965) and other papers. The surface conduction electron-emitting device utilizes the phenomenon that when current is flowed in a thin film having a small area formed on a substrate in a direction parallel to the film surface, electron emission occurs. Reported thin films for a surface conduction electron-emitting device include an $SnO_2$ thin film by Elinson et al, an Au thin film ("Thin Solid Films", by G. Ditter, 9, 317 (1972)), an $In_2O_3/SnO_2$ thin film ("IEEE Trans. ED Conf.", by M. Hartwell and C. G. Fonstad, 519 (1975)), a carbon thin film ("Vacuum", by Hisashi ARAKI, et al. vol. 26, No. 1. p. 22 (1983)), and the like.

As a typical example of a surface conduction electron-emitting device, the structure of an element proposed by M. Hartwell is schematically shown in FIG. 20. In FIG. 20, reference numeral 3001 represents a substrate, and reference numeral 3004 represents an electroconductive thin film which is made of a metal oxide thin film having an H-character shape formed through sputtering. An electron-emitting region 3005 is formed in the electroconductive thin film by an energization operation called an energization forming operation to be described later. A distance L is set to 0.5 to 1 mm, and a width W is set to 0.1 mm. The electron-emitting region 3005 is shown in the center of the electroconductive thin film 3004 as having a rectangular shape. These shape and position are schematically shown by way of example only for the convenience of drawing the device structure, and do not show actual shape and position.

Conventionally, the electron-emitting region 3005 of a surface conduction electron-emitting device is generally formed in the electroconductive thin film 3004 by the energization operation called the energization forming operation, so as to enable electron emission. With the energization forming operation, a d.c. voltage or a voltage rising very gently, e.g., at about 1 V/min, is applied across opposite ends of the electroconductive thin film 3004 to locally break, deform, or decompose the film 3004 to from the electron-emitting region 3005 having a high electric resistance. Fissures are formed partially in the electroconductive thin film 3004 locally broken, deformed, or decomposed. Electrons are emitted from the fissures and nearby areas when a proper voltage is applied to the electroconductive thin film 3004 after the energization forming operation.

Examples of the FE type are disclosed in "Field emission", by W. P. Dyke & W. W. Dolan, Advance in Electron Physics, 8, 89 (1956), "Physical properties of thin-film field emission cathodes with molybdenum cones", by C. A. Spindt, J. Appl. Phys., 47, 5248 (1976) and other papers.

A typical example of the structure of the FE type device proposed by C. A. Spindt, et al is shown in the cross sectional view of FIG. 21. In FIG. 21, reference numeral 3010 represents a substrate, reference numeral 3011 represents an emitter wiring made of electroconductive material, reference numeral 3012 represents an emitter cone, reference numeral 3013 represents an insulating layer, and reference numeral 3014 represents a gate electrode. As a proper voltage is applied between the emitter cone 3012 and gate electrode 3014 of this device, electrons are emitted from the tip of the emitter cone 3012. Another structure of the FE type device has the emitter and gate electrode disposed on the substrate generally in parallel to the substrate surface, as different from the lamination structure shown in FIG. 21.

Examples of the MIM type are disclosed in "Operation of Tunnel-Emission Devices", by C. A. Mead, J. Appl., Phys., 32, 646 (1961) and other papers. A typical example of the MIM type device structure is shown in the cross sectional view of FIG. 22. In FIG. 22, reference numeral 3020 represents a substrate, reference numeral 3021 represents a lower electrode made of metal, reference numeral 3022 represents an insulating film as thin as about 100 angstroms, and reference numeral 3023 represents an upper electrode made of metal and having a thickness of about 80 to 300 angstroms. When a proper voltage is applied across the upper electrode 3023 and lower electrode 3021 of the MIM type device, electrons are emitted from the surface of the upper electrode 3023.

As compared to a hot cathode electron-emitting device, a cold cathode electron-emitting device can emit electrons at a lower temperature so that a heater is not necessary. Therefore, the structure of the cold cathode electron-emitting device is simple and a small device can be manufactured. Furthermore, even if a number of devices are mounted on a substrate at a high integration, a problem that the substrate is heated and melted is not likely to occur. As different from a slow response time of the hot cathode electron-emitting device because it operates by heating the cathode with a heater, the cold cathode electron-emitting device has a fast response time.

From the above reasons, researches are widely conducted in order to use cold cathode electron-emitting devices in various fields.

For example, since the structure of a surface conduction electron-emitting device among cold cathode electron-emitting devices is simple and the manufacture thereof is easy, a number of elements can be disposed in a large area. A method of driving a number of devices disposed on a substrate has been studied, for example, as disclosed in Japanese Patent Application Laid-open No. 64-31332.

As applications of surface conduction electron-emitting devices to an image forming apparatus such as an image display apparatus and an image forming apparatus, a charged beam source and the like have been studied. An application to the image display apparatus has been studied which uses a combination of surface conduction electron-emitting devices and fluorescent members radiating light upon application of an electron beam, as disclosed in U.S. Pat. No. 5,066,883, Japanese Patent Application Laid-open Nos. 2-257551 and 4-28137. The image forming apparatus using a combination of surface conduction electron-emitting devices and fluorescent members has excellent characteristics expected more than other types of conventional image forming apparatuses. For example, as compared to recently prevailing liquid crystal display apparatuses, the image forming apparatus is of a self light emission type so that it has advantages such as no back light and a broad view angle.

A method of driving a number of FE type devices disposed on a substrate is disclosed, for example, in U.S. Pat. No. 4,904,895 assigned to the present assignee. An example of application of FE type devices to an image forming apparatus is a flat panel display apparatus reported, for example, in "Recent Development on Microtips Display at LETI", by R. Meyer, Tech. Digest of 4th Int. Vacuum Micro electronics Conf., Nagahama, pp. 6 to 9 (1981).

An example of an image forming apparatus using a number of MIM type devices is disclosed, for example, in Japanese Patent Application Laid-open No. 3-55738.

Of the image forming apparatuses using electron-emitting devices, a thin, flat panel type display apparatus is light in weight and does not require a large installation space. The flat panel display apparatus has drawn attention as can be replaced by a CRT display apparatus.

FIG. 23 is a perspective view showing an example of a display panel of a flat type image forming apparatus and partially broken to show the internal structure thereof.

In FIG. 23, reference numeral 3115 represents a rear plate, reference numeral 3116 represents a side wall, and reference numeral 3117 represents a face plate. The rear plate 3115, side wall 3116, and face plate 3117 constitute an envelope (hermetically sealed container) which maintains the vacuum state of the inside of the display panel.

A substrate 3111 is fixed to the rear plate 3115 and formed with n×m cold cathode devices (n and m are a positive integer of 2 or larger and are properly set in accordance with the number of necessary pixels). As shown in FIG. 23, the n×m cold cathode devices 3112 are wired to m row-directional wiring patterns 3113 and n column-directional wiring patterns 3114. The structure constituted of the substrate 3111, cold cathode devices 3112, row- and column-directional wiring patterns 3113 and 3114 are called a multi-electron beam source. An insulating layer (not shown) is formed at least in the cross area between the row- and column-directional wiring patterns to electrically insulate the wiring patterns.

The inner surface of the face plate 3117 is formed with a fluorescent film 3118 made of fluorescent materials of red (R), green (G), and blue (B) primary colors. A black body (not shown) is formed between fluorescent materials of each color of the fluorescent film 3118. A metal back 3119 made of Al is formed on the fluorescent film 3118 on the side of the rear plate 3115.

Dx1 to Dxm and Dy1 to Dyn represent connection terminals of an air tight structure for electrically connecting the display panel to an unrepresented external electronic circuit. Dx1 to Dxm are electrically connected to the row-directional wiring patterns 3113 of the multi electron beam source, Dy1 to Dyn are electrically connected to the column-directional wiring patterns 3114 of the multi electron beam source, and Hv is electrically connected to the metal back 3119.

The inside of the air-tight envelope is maintained in a vacuum state of about $10^{-6}$ Torr. As the display area of the image forming apparatus becomes large, a pressure difference between the inside and outside of the air-tight envelope becomes large. Therefore, it is necessary to provide means for preventing deformation or breakage of the rear plate 3115 and face plate 3117. If the rear plate 3115 and face plate 3117 are made thick, not only the weight of the image forming apparatus increases but also distortion and parallax of an image appear when the image is viewed obliquely. In the example shown in FIG. 23, a structure support (called a spacer or rib) 3120 made of a relatively thin glass plate is provided for supporting the atmospheric pressure. A space between the substrate 3111 formed with the multi electron beam source and the face plate 3116 formed with the fluorescent film 3118 is generally maintained in the order of sub-millimeter to several millimeters and the inside of the air-tight envelope is maintained in a high vacuum state.

With the image forming apparatus using the display panel described above, when a voltage is applied to each cold cathode device 3112 via the terminals Dx1 to Dxm and Dy1 to Dyn, electrons are emitted from the cold cathode device 3112. At the same time, a high voltage of several hundred V to several kV is applied to the terminal Hv to accelerate the emitted electrons and collide them with the inner surface of the face plate 3117, so that the fluorescent material of each color of the fluorescent film 3118 is excited to radiate light and display an image.

The display panel of the image forming apparatus described above is associated with the following problems.

Firstly, the spacer 3120 is possibly charged because some electrons emitted near the spacer 3120 collide with the spacer 3120 or because of a reaction of electron emission. The trajectory of electrons emitted from the cold cathode device 3112 may be deflected by the charged spacer and the electrons reach positions different from normal positions on the fluorescent film. Therefore, an image near the spacer is distorted.

Secondly, in order to accelerate electrons emitted from the cold cathode devices 3112, a high voltage of several hundred V or higher (i.e., high electric field of 1 kV/mm or higher) is applied between the multi beam electron source and the face plate 3117. There is a fear of creeping discharge on the surface of the spacer 3120. If the spacer is charged, this creeping discharge is possibly induced.

In order to solve the above problems, it has been proposed to flow a small current through the spacer to eliminate charges (Japanese Patent Application Laid-open Nos. 57-118356, 61-124031). In this proposal, a small current is flowed through the spacer surface by forming a high resistance thin film on the insulating spacer surface. This charge-up suppressing film is made of a tin oxide film, a mixed crystal thin film of tin oxide and indium oxide, or a metal film.

A semiconductor thin film such as tin oxide used in this proposal is very sensitive to gas such as oxygen to the degree that it is used for a gas sensor. Therefore, this thin film is likely to change its resistance value with the atmosphere. The above materials and metal film have a low resistivity so that a film is formed in an island shape or very thin in order to obtain a high resistance value. A conventional high resistance film is therefore associated with difficult reproductivity and is likely to change its resistance by a thermal process such as frit sealing and baking during the display assembly process.

Furthermore, the amount of secondary electrons generated when some electrons emitted near the spacer 3120 collide with the high resistance film depends on the conditions and thickness of the high resistance film. Therefore, there is a variation in the degree of removing charges in the in-plane of the high resistance film formed in an island shape or very thin.

SUMMARY OF THE INVENTION

The present application discloses the invention which can solve the problems of a conventional spacer and provide a high reliability charge-up suppressing film for a spacer and an image forming apparatus using the charge-up suppressing film.

The charge-up suppressing film of this invention is configured as in the following.

The charge-up suppressing film comprises an electroconductive first film and a second film formed on the first film to partially expose the first film.

Specifically, it is preferable that the surface has a sufficiently large number of unevenness as viewed in a cross section taken along a normal to the charge-up suppressing film. In this invention, the second film is partially formed and the first film is partially exposed so that charges are difficult to be generated. Since charges are difficult to be generated and the first film is electroconductive, charges can be removed easily.

The secondary electron emission coefficient of the second film is preferably smaller than that of the partially exposed first film.

The second film may be formed on the first film in an island shape.

The second film may be formed on the first film in a dispersed manner.

The first film may have a thickness of 10 nm to 1 $\mu$m. The second film may have a thickness of 1 nm to 10 nm.

Various materials can be used for the second film. For example, the material may be carbon or electroconductive particles. The conductivity of the second film may be lower than that of the first film.

The member of the invention is configured as in the following.

A member comprises a first electroconductive member and a second member formed on the first member to partially expose the first member.

The first member may be formed on a substrate, and the substrate may be electrically insulative. The first member may be a film formed on the substrate.

An electron beam apparatus of this invention is configured as in the following.

An electron beam apparatus comprises an electron source, a radiative member on which electrons emitted from the electron source is radiated, and a third member provided between the electron source and the radiative member, the third member comprising an electroconductive first member and a second member formed on the first member to partially expose the first member.

The third member may be a support member for supporting a distance between the electron source or a first substrate formed with the electron source and the radiative member or a second substrate formed with the radiative member. Specifically, the third member is a spacer or an outer frame.

An image forming apparatus of the invention is configured as in the following.

An image forming apparatus comprises an electron source, an image forming member for forming an image based on electrons emitted from the electron source, and a third member provided between the electron source and the image forming member, the third member comprising an electroconductive first member and a second member formed on the first member to partially expose the first member.

DETAILED DESCRIPTION OF THE PREFERRED EMBODIMENTS

Embodiments of the invention will be described with reference to the accompanying drawings.

The structure of a spacer to which the invention is applied will be described. This structure is particularly effective when the invention is applied to the spacer. Spacers of a display using an electron beam are used for maintaining a space between a substrate formed with an electron source and a substrate provided with fluorescent material.

In the following embodiments, on electroconductive material or more specifically, on an electroconductive first film formed on a substrate, a second material is formed on the first film to partially expose the first film. Generally, a secondary electron emission coefficient is minimum when an electron becomes vertically incident upon a surface of a substance, and it increases by $1/\cos\theta$ when an electron becomes obliquely incident upon the surface at an angle $\theta$ relative to the normal to the surface.

If a second material is partially provided on the surface of a first material, even if the incidence angle of an electron relative to the first material is large relative to the surface of the first material, the incidence angle relative to the second material becomes likely to be small so that charges can be suppressed.

Several embodiments will be described more specifically.

First Embodiment

An electroconductive first film was formed on a non-conductive substrate, and a second film was formed on the first film to partially expose the first film. In this embodiment, carbon was used as the material of the second film.

(Description of Structure of Charge-up Suppressing Film)

Figure 1A:
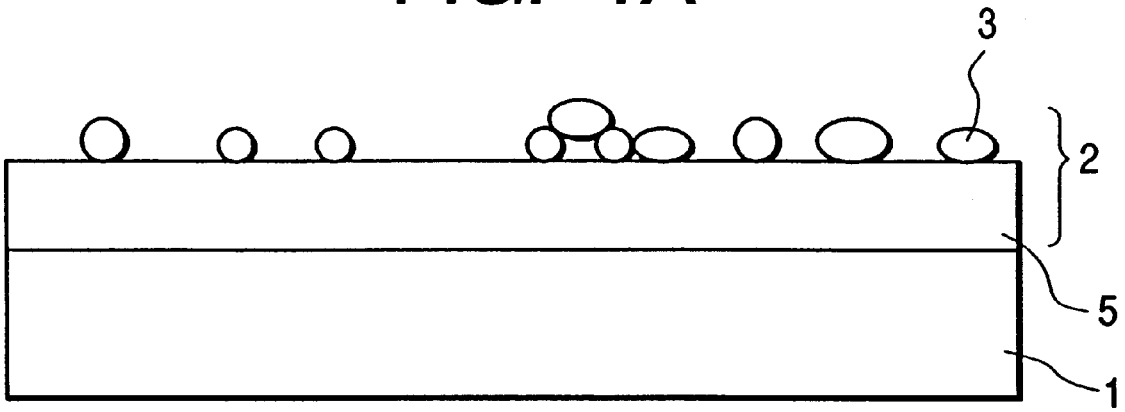
FIGS. 1A and 1B are schematic cross sectional views showing charge-up suppressing films according to an embodiment of the invention.
Figure 1B:
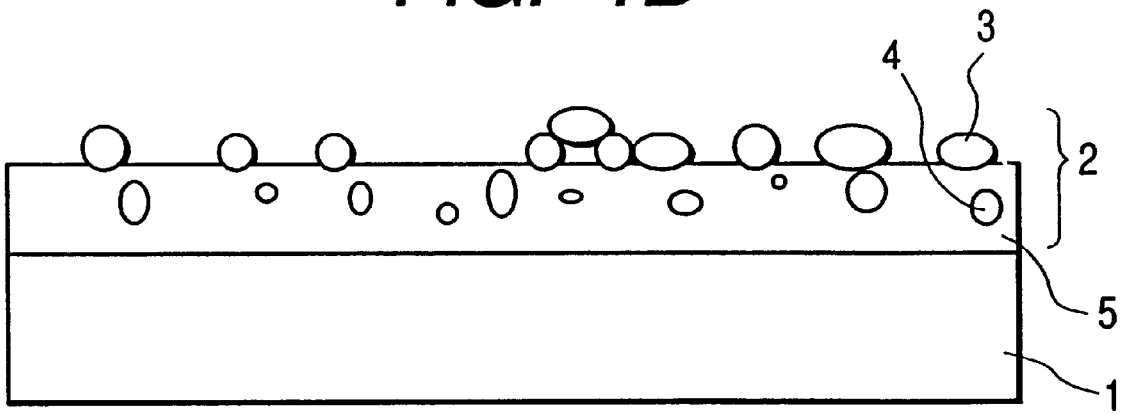

A charge-up suppressing film formed on a spacer and used in the first to fourth embodiments will be described with reference to schematic diagrams of FIGS. 1A and 1B. In FIGS. 1A and 1B, reference numeral 1 represents an insulating member which is to be protected from charges. Reference numeral 2 represents a charge-up suppressing film formed on the surface of the insulating member 1. The charge-up suppressing film 2 is constituted of a semiconductor film 5 and carbons 3 deposited in an island shape, or of the semiconductor film 5 and carbons 3 deposited in an island shape and carbons 4 dispersed in the semiconductor film 5.

(Structure of Image Forming Apparatus)

Figure 4:
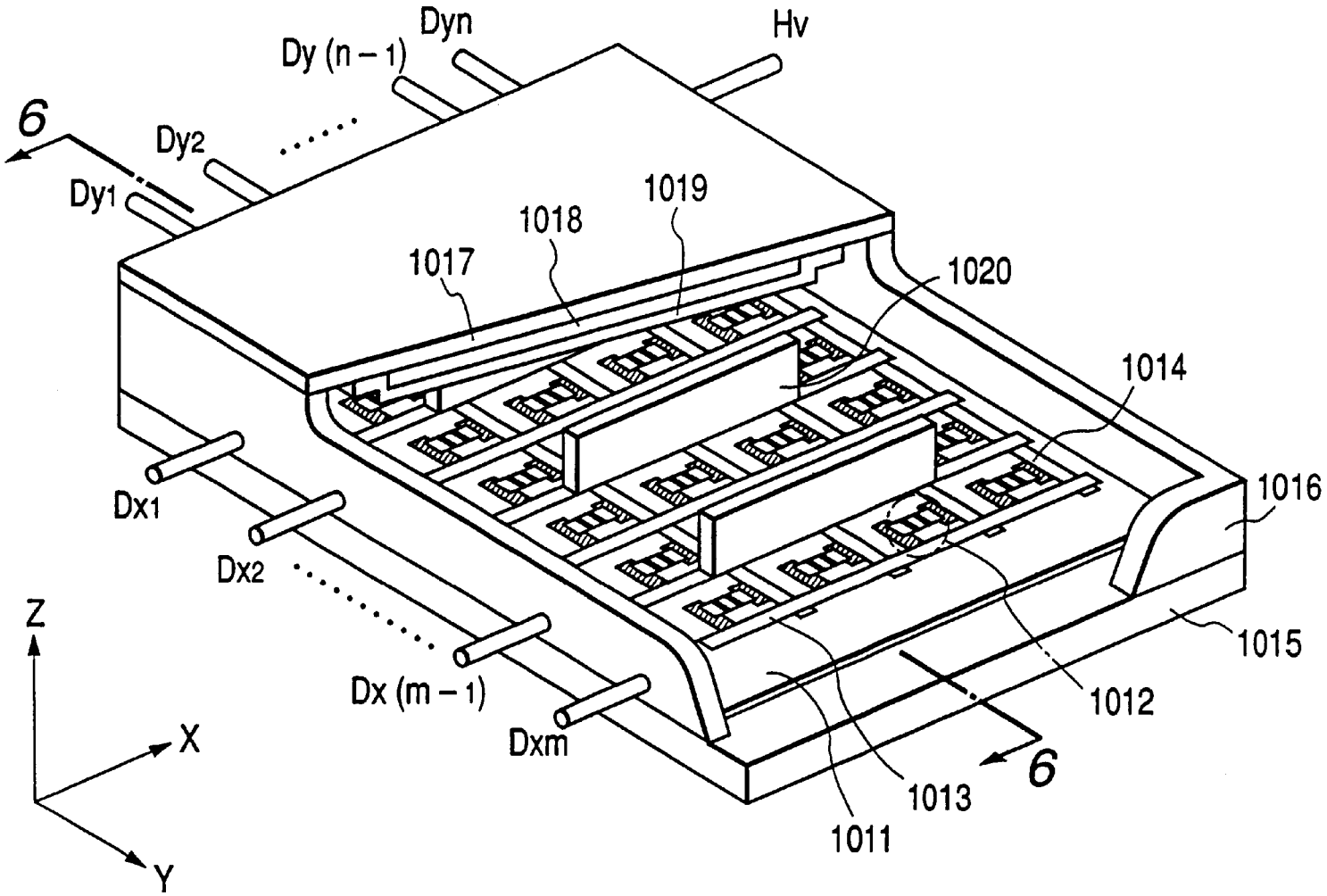
FIG. 4 is a partially broken perspective view showing a display panel of an image forming apparatus according to the embodiment of the invention.

This embodiment provides a flat type image forming apparatus (electron beam apparatus) using spacers formed with the charge-up suppressing film. As shown in FIG. 4 which shows the outline structure of this display apparatus (the details of which will be later described), the display apparatus has a substrate 1011 formed with a plurality of cold cathode devices 1012 and a transparent face plate 1017 formed with a fluorescent film 1018 for radiating light, which are disposed facing each other via spacers 1020. Each spacer 1020 is constituted of an insulating member, a semiconductor film having a specific resistance of 0.1 to $10^8$ Ωcm and formed on the insulating member, and carbons deposited in an island shape on the surface of the semiconductor film, or of the insulating member, the semiconductor film having a specific resistance of 0.1 to $10^8$ Ωcm, including a carbon dispersed layer and formed on the insulating member, and carbons deposited in an island shape on the surface of the semiconductor film.

In the image forming apparatus of the embodiment, one side of the spacer 1020 is electrically connected to a wiring pattern 1013 on the substrate 1011 formed with cold cathode devices. The opposing side of the spacer is electrically connected to an acceleration electrode (metal back 1019) for making electrons emitted from each cold cathode device collide with the fluorescent film 1018 with a high energy for radiating light. Namely, current flows through the charge-up suppressing film formed on the surface of the spacer 1020, the current having an approximate value obtained by dividing the acceleration voltage by the resistance of the charge-up suppressing film.

(Description of Forming Charge-up Suppressing Film)

The resistance value Rs of the spacer 1020 is set in a desired range from the viewpoint of charge-up suppressing and power consumption. From the viewpoint of charge-up suppressing, the surface resistance Rs is preferably $10^{12}$ Ω or smaller. In order to ensure sufficient charge-up suppressing effects, the surface resistance value Rs is more preferably $10^{11}$ Ω or smaller. Although a lower limit of the surface resistance depends on the voltage applied to the spacer and the spacer dimension, it is preferable to set to $10^5$ Ω or higher.

A thickness t of the charge-up suppressing film formed on the insulating material is preferably in a range from 10 nm to 1 μm. Although the structure of a film depends on a surface energy of material, a degree of tight contact with the substrate, and a substrate temperature, a thin film having a thickness of 10 nm or thinner formed generally in an island shape has unstable resistance less reproductivity. On the other hand, if the film thickness is 1 μm or thicker, a film stress becomes large, a possibility of film peel-off becomes high, and the productivity is low because of a long film forming time. The film thickness is therefore more preferably 50 to 500 nm.

The surface resistance Rs is given by $\rho/t$. According to the above-described preferable ranges of the surface resistance Rs and film thickness t, the specific resistance $\rho$ of the charge-up suppressing film is preferably in the range from 0.1 to $10^8$ Ωcm. According to the more preferable ranges of the surface resistance Rs and film thickness t, the specific resistance $\rho$ of the charge-up suppressing film is more preferably in the range from $10^2$ Ω to $10^6$ Ωcm. If the specific resistance $\rho$ is lower than this, the power consumption at a high voltage increases to make the device too hot, whereas if the specific resistance $\rho$ is higher than this, the charge-up suppressing effects are degraded. The range from $10^2$ Ω to $10^6$ Ωcm is used because the ratio of the spacer power consumption to the image display power consumption of the image forming apparatus is rational and this range provides the charge-up suppressing effects greatly.

The temperature of the spacer 1020 rises because current flows through the charge-up suppressing film on the spacer and the display apparatus itself generates heat during its operation. If the temperature coefficient of the resistance of the charge-up suppressing film has a large negative value, as the temperature rises, the resistance value lowers so that current flowing through the spacer 1020 increases to further raise the temperature, and the current increases until it reaches its limit. The resistance temperature coefficient causing such current runaway is empirically a negative value whose absolute value is 1% or higher. It is therefore preferable that the resistance temperature coefficient of the charge-up suppressing film is a negative value whose absolute value is lower than 1%.

As the material of the charge-up suppressing film, metal oxide is excellent. Of metal oxides, oxides of chrome, nickel, and copper are preferable. The reason for this may be ascribed to that these oxides have a relatively small secondary electron emission coefficient and even if electrons emitted from the electron-emitting device collide with the spacer, the spacer is hard to be charged. In addition to the metal oxide, carbon is preferable because it has a small secondary electron emission coefficient.

However, the resistance value of the metal oxide or carbon is difficult to be adjusted to the specific range suitable for the charge-up suppressing film or is likely to be changed with an atmosphere. Therefore, using only these materials results in a difficulty in controlling the resistance value.

Nitrides of aluminum and transition metal compound are easy to control resistance values in a range from a good conductor to an insulating material, by adjusting the composition of the transition metal. It is therefore expected to use such materials as the material of the charge-up suppressing film of the spacer. These materials are also stable because the resistance change is small during the processes of manufacturing the display apparatus to be later described, and is practically easy to use because the resistance temperature coefficient is a negative value whose absolute value is 1% or smaller. Transition metal elements may be Ti, Cr, or Ts. If the transition metal component is 5 atom % or higher, the specific resistance is $10^8$ Ωcm or lower, providing the charge-up suppressing effects.

The ratio of the transition metal contained in the charge-up suppressing film used with a spacer is preferably 5 to 60 atom % relative to Al.

The charge-up suppressing film of the first to fourth embodiments is constituted, as shown in FIGS. 1A and 1B, of a semiconductor film 5 made of an aluminum transition metal alloy nitride film (hereinafter abbreviated as an alloy nitride film), carbons deposited on the surface of the alloy nitride film 5 in an island shape, or of the semiconductor film 5 made of the alloy nitride film and including a layer with carbons dispersed, and carbons deposited on the surface of the alloy nitride film 5 in an island shape.

The resistance value of the charge-up suppressing film is generally determined from the resistance value of the alloy nitride film. By providing the carbons near on the surface of the alloy nitride film having the effects of suppressing secondary electron emission, it is possible to form a charge-up suppressing film having a desired specific resistance range.

The energy of an electron emitted near from the spacer 1020 and became incident upon the spacer surface is determined by the voltage applied across the rear plate and face plate. This voltage is in a range from about several kV to about several ten kV.

Most of the trajectories of emitted electrons are obliquely incident upon the spacer 1020. Generally, a secondary electron emission coefficient is minimum when an electron becomes vertically incident upon a surface of a substance, and it increases by 1/cos θ when an electron becomes obliquely incident upon the surface at an angle θ relative to the normal to the surface.

If a flat film of carbons is formed on the alloy nitride film, electrons obliquely incident upon the carbon film may lower the essential effects of suppressing charges.

Figure 2:
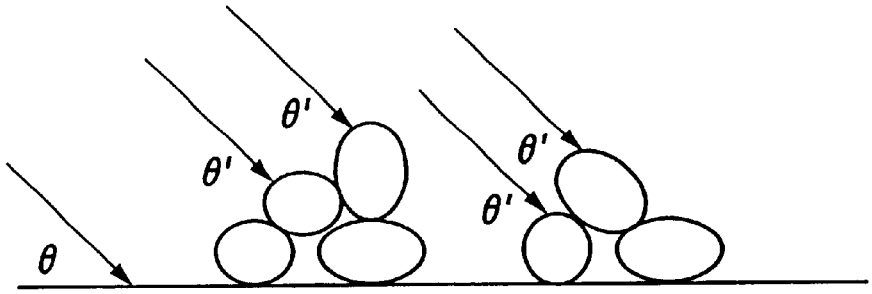
FIG. 2 is a schematic diagram showing incidence angles of electron beams near particles deposited in an island shape on the surface of an antistatic layer of the invention.

Conversely, if carbons are formed on the surface of the alloy nitride film in an island shape, as shown in FIG. 2, electron beams obliquely incident upon the surface of the spacer 1020 at an incidence angle θ become locally incident upon the surface of each carbon particle at an angle (θ') near the normal direction to the surface. It is therefore possible to maintain to suppress the secondary electron emission coefficient, and for the carbon particle to sufficiently provide the charge-up suppressing effects.

Figure 3A:
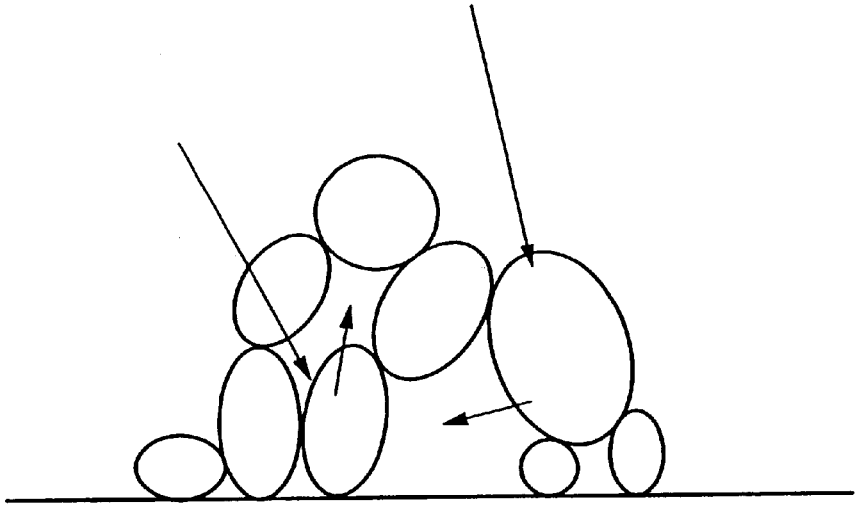
FIGS. 3A and 3B are schematic diagrams showing incidence angles of electron beams near particles deposited in an island shape on the surface of an antistatic layer of the invention.

If each carbon particle formed in the island shape has a small diameter, as shown in FIG. 3A, an electron passing through one carbon particle becomes incident upon an adjacent carbon particle. In this case, secondary electrons are emitted to a space between particles so that the amount of secondary electrons emitted from the spacer surface can be reduced.

Figure 3B:
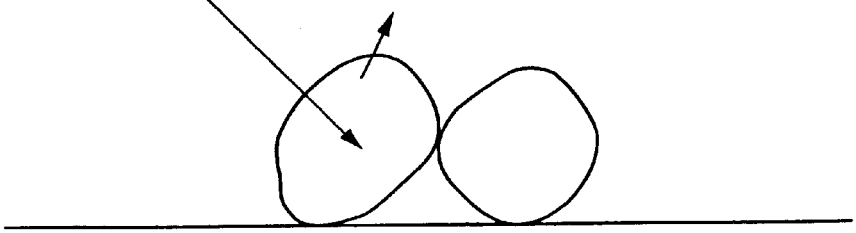

If the particle diameter is large as shown in FIG. 3B, secondary electrons emitted from the carbon particle are emitted from the spacer surface and the charge-up suppressing effects may be reduced.

A depth of emitted secondary electrons differs from one material to another. Assuming that an electron is vertically incident upon the material surface, the depth is estimated to be about several nm to 20 nm. If carbons are dispersed from the surface to this depth, secondary electrons collide with carbons and secondary electron emission can be suppressed.

The secondary electron emission coefficient of carbon is nearly 1 so that carbon is optimum for suppressing charges. However, it is difficult to form a carbon semiconductor film having a stable resistance.

If carbons are deposited on the semiconductor film in an island shape, the resistance of the spacer is determined by the semiconductor film so that this film can be used for suppressing secondary electron emission.

The alloy nitride film regulating the spacer resistance is formed on the insulating member by thin film forming means such as sputtering, reactive sputtering in a nitrogen gas atmosphere, electron beam vapor evaporation, ion plating, and ion assist vapor evaporation.

If carbons are deposited to a thickness of several nm through vapor evaporation, sputtering, CVD, or plasma CVD, they can be deposited in the island shape. Therefore, by alternately forming an alloy nitride film and island shape carbons in the final stage of forming the alloy nitride film, it is possible to form the alloy nitride film having a surface layer with carbons dispersed. If amorphous carbons are to be formed, hydrogen may be introduced into the film forming atmosphere, or hydrocarbon gas may be used as the film forming gas. If carbons are to be deposited on the surface of a semiconductor film in the island shape, similar methods described above may be used.

In the case of CVD and plasma CVD, $CH_4$ and $C_4H_{10}$ diluted with hydrogen may be used as carbon source materials.

In the above, the charge-up suppressing film is used for preventing charges of the spacers of the flat type display apparatus. The charge-up suppressing film may be used to other applications.

(Structure and Manufacture Method of Image Forming Apparatus)

Next, the structure and manufacture method of a display panel of the image forming apparatus of this embodiment will be described specifically.

FIG. 4 is a perspective view showing an example of a display panel of the embodiment and being partially broken to show the internal structure thereof.

In FIG. 4, reference numeral 1015 represents a rear plate, reference numeral 1016 represents a side wall, and reference numeral 1017 represents a face plate. The rear plate 1015, side wall 1016, and face plate 1017 constitute an air-tight envelope which maintains the vacuum state of the inside of the display panel. In assembling the air-tight envelope, junctions between respective components are required to be sealed in order to maintain an air-tightness and sufficient strength. For example, frit glass is coated on the junctions and the panel display is cured for 10 minutes or longer at 400 to 500° C. in the atmospheric air or in a nitrogen atmosphere. A method of evacuating the inside of the air-tight envelope will be later described. Since the inside of the air-tight envelope is maintained in a vacuum state of about $1\times10^{-6}$ Torr, spacers 1020 serve as a structure resistant to the atmospheric pressure in order to prevent the air-tight envelope from being broken by the atmospheric pressure or unexpected impact force.

A substrate 1011 is fixed to the rear plate 1015 and formed with n×m cold cathode devices. n and m are a positive integer of 2 or larger and are properly set in accordance with the number of necessary pixels. For example, for a display panel used as a high definition television, it is preferable to set n to 3000 and m to 1000 or more. The n×m cold cathode devices 1012 are wired to m row-directional wiring patterns 1013 and n column-directional wiring patterns 1014 to form a simple matrix layout. The structure constituted of the substrate 1011, cold cathode devices 1012, row- and column-directional wiring patterns 1013 and 1014 is called a multi electron beam source.

The material, shape, and manufacture of a cold cathode device of the multi electron beam source used by the image forming apparatus of the embodiment are not limited so long as the electron source has cold cathode devices wired in a simple matrix layout. For example, surface conduction electron-emitting devices, FE type or MIM type cold cathode devices may be used.

In this embodiment, the substrate 1011 of the multi electron beam source is fixed to the rear plate 1015 of the air-tight envelope. If the substrate 1011 of the multi electron beam source has sufficient strength, the substrate 1011 of the multi electron beam source itself may be used as the rear plate of the air-tight envelope.

Figure 5A:
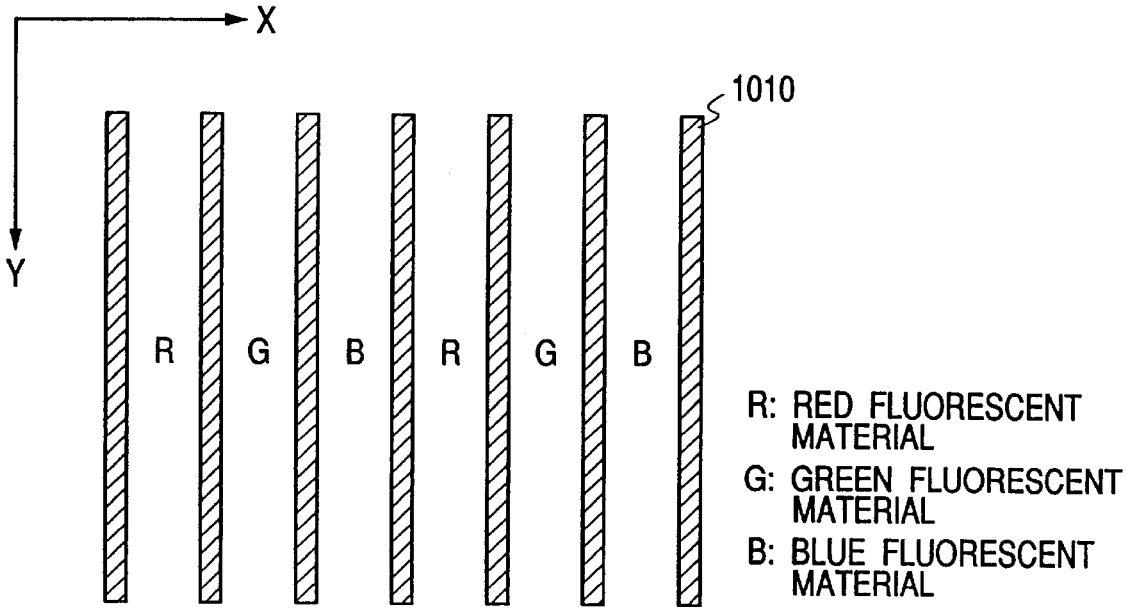
FIGS. 5A and 5B are plan views showing examples of the layout of fluorescent materials on the face plate of the display panel.

The inner surface of the face plate 1017 is formed with a fluorescent film 1018. Since the panel display of this embodiment is a color display, the fluorescent film 1018 is made of fluorescent materials of red (R), green (G), and blue (B) primary colors used in the technical field of CRT. Fluorescent material of each color is coated in a stripe shape as shown in FIG. 5A, and a black electroconductive material 1010 is formed between fluorescent materials. The black electroconductive material 1010 is provided in order to prevent mixture of display colors even if the radiated positions of electron beams are displaced more or less, to suppress the contrast from being lowered by external light reflection, and to prevent charge up of the fluorescent film by electron beams. Although the material whose main composition is black lead is used, other materials achieving the above objects may also be used.

Figure 5B:
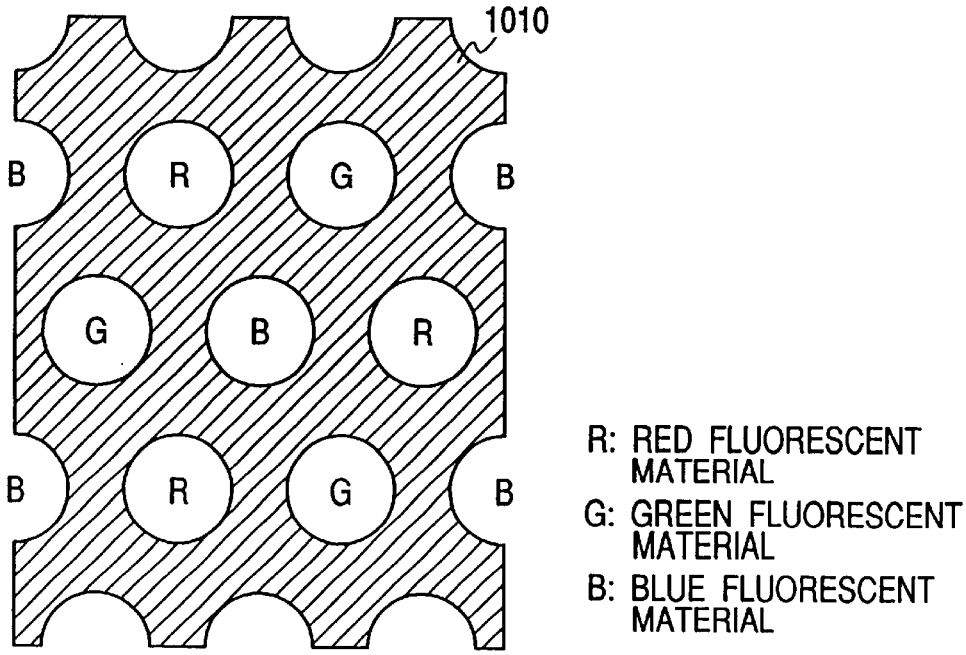
Figure 19:
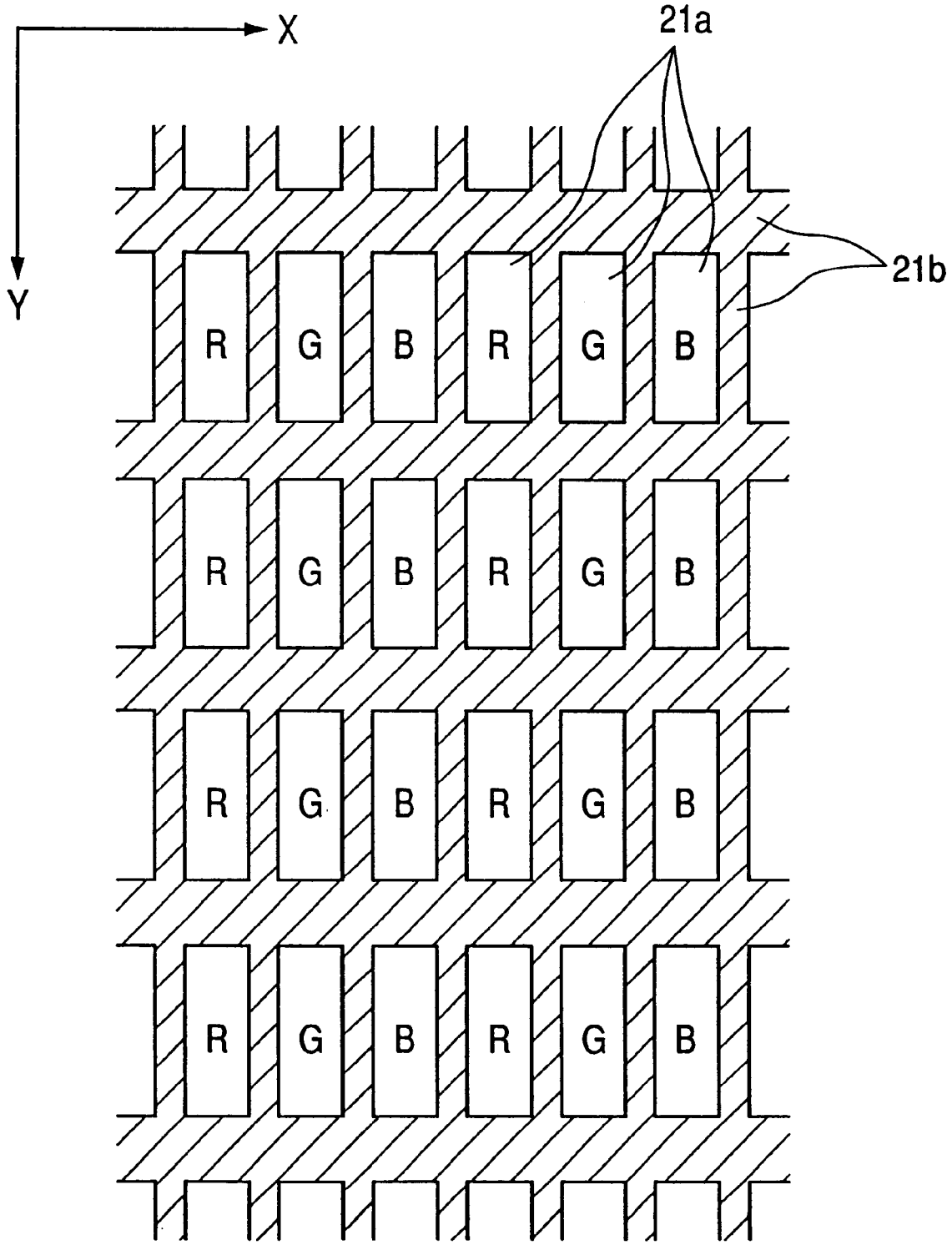
FIG. 19 is a diagram showing another structure of a fluorescent film.
Figure 20:
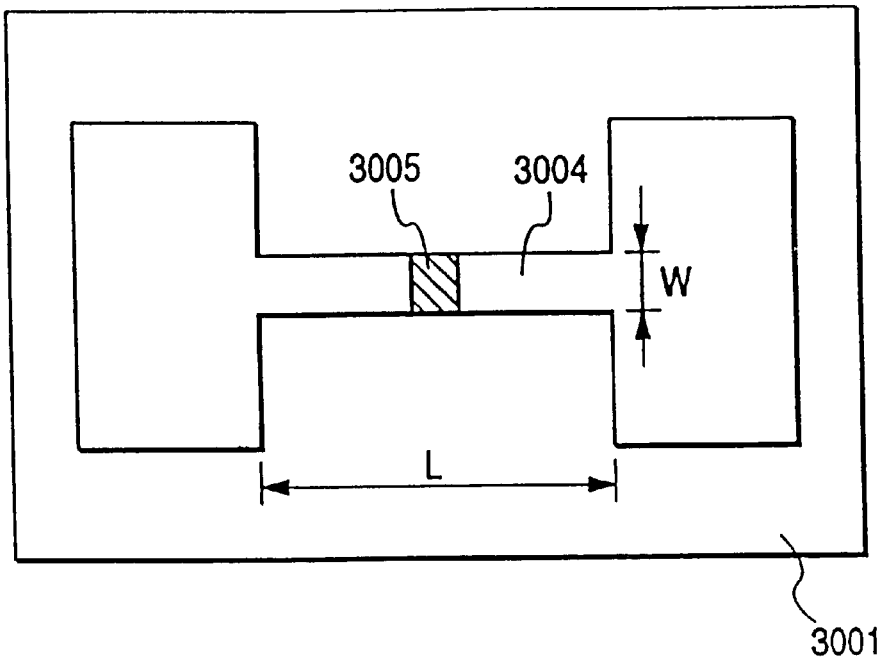
FIG. 20 (PRIOR ART)
FIG. 20 shows an example of a conventional surface conduction electron-emitting device.
Figure 21:
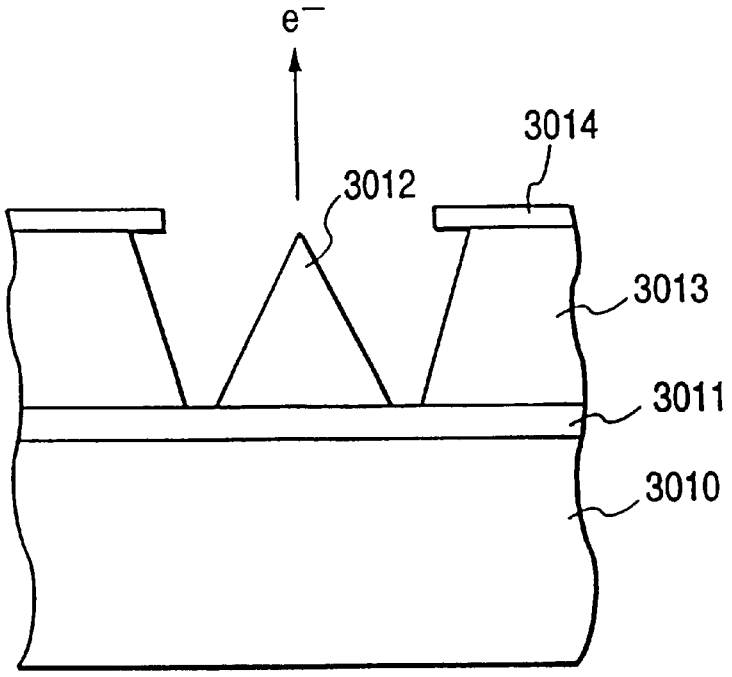
FIG. 21 (PRIOR ART)
FIG. 21 shows an example of a conventional FE type device.
Figure 22:
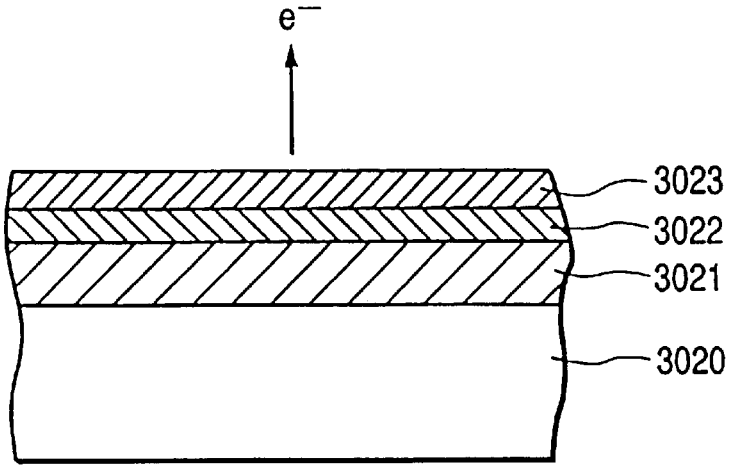
FIG. 22 (PRIOR ART)
FIG. 22 shows an example of a conventional MIM type device.

The layout of the fluorescent materials of the three primary colors is not limited to a stripe pattern shown in FIG. 5A, but a delta pattern such as shown in FIG. 5B or other patterns may be used. As shown in FIG. 19, fluorescent materials 21*a* and a black matrix 21*b* may be used.

If a black-and-white display panel is to be formed, the fluorescent film 1018 made of monochromatic fluorescent material is used, and the black electroconductive material is not necessarily required.

A metal back 1019 known in the technical field of CRT is mounted on the inner surface of the fluorescent film 1018 on the rear plate side. The objects of the metal back 1019 are to improve a luminance by mirror-reflecting part of light radiated to the inner surface from the fluorescent film 1018, to protect the fluorescent film 1018 from collision of negative ions, to use the metal back as an electrode for applying an electron beam acceleration voltage, and to use the metal back 1019 as a path of electrons for exciting the fluorescent film 1018. After the fluorescent film 1018 is formed on the face plate substrate 1017, the inner surface of the fluorescent film is subjected to a smoothing process and thereafter Al is deposited through vacuum evaporation to form the metal back 1019. If the fluorescent film 1018 is made of fluorescent material for low voltage operation, the metal back 1019 is not used.

In order to improve the conductivity of the fluorescent film or to apply an acceleration voltage, a transparent electrode made of, for example, ITO, may be formed between the face plate substrate 1017 and fluorescent film 1018.

Figure 6:
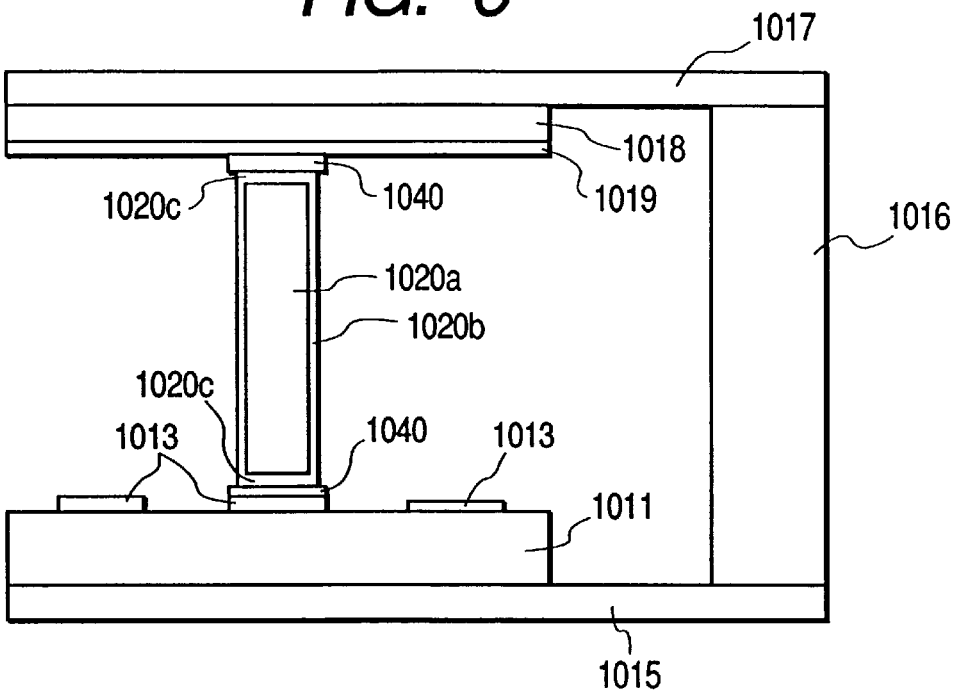
FIG. 6 is a cross sectional view of the display panel of the embodiment taken along line 6—6 in FIG. 4.
Figure 7:
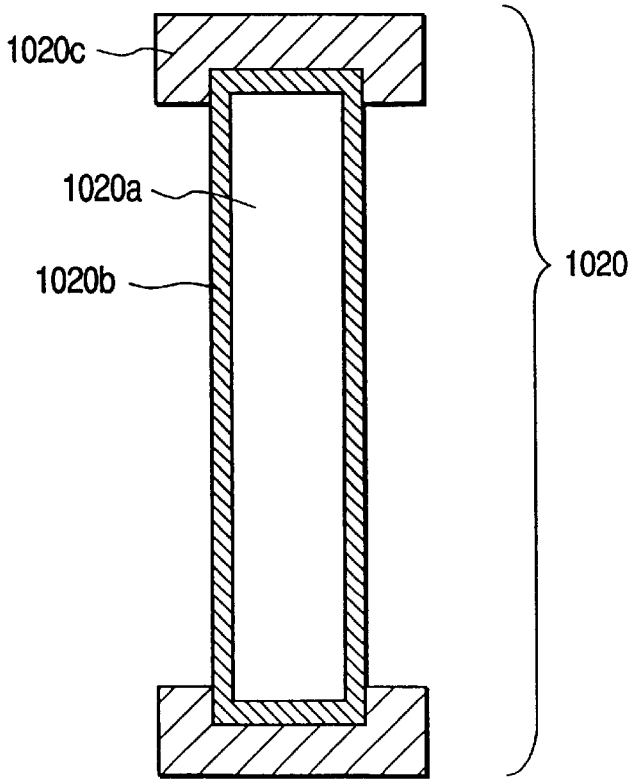
FIG. 7 is a schematic cross sectional view showing a charge-up suppressing film according to the embodiment of the invention.

FIG. 6 is a schematic cross sectional view taken along line 6—6 of FIG. 4, and FIG. 7 is a schematic cross sectional view of the spacer 1020. In FIGS. 6 and 7, reference numerals correspond to those used in FIG. 4. The spacer 1020 is constituted of a semiconductor film 1020*b* for charge-up suppressing formed on the surface of an insulating member 1020*a* serving as a spacer substrate and a member formed with a low resistance film 1020*c* on the junction surfaces of the spacer 1020 against the inner side (metal back 1019 and the like) of the face plate 1017 and the surface (row-or column-directional wiring patterns 1013 and 1014) of the substrate 1011. The spacers are disposed as many as necessary for achieving the above-described objects and at a necessary interval, and fixed to the inner side of the face plate 1017 and the surface of the substrate 1011, with an electroconductive bonding member 1040.

The charge-up suppressing film 1020*b* is formed at least on the surface of the air-tight envelope exposed in the vacuum, and are electrically connected to the inner side (metal back 1019 and the like) of the face plate 1017 and the surface (row- or column-directional wiring patterns 1013 and 1014) of the substrate 1011, via the low resistance films 1020*c* on the spacer 1020 and electroconductive bonding member 1040.

In this embodiment, the spacer 1020 is of a thin plate shape and disposed in parallel to, and electrically connected to, the row-directional wiring pattern 1013.

It is necessary for the spacer 1020 to have an insulating property resistant to a high voltage applied across the row- and column-directional wiring patterns 1013 and 1014 on the substrate 1011 and the metal back 1019 on the inner surface of the face plate 1017, and also to have a conductivity to the degree capable of preventing charges on the surface of the spacer 1020, as already described above.

The material of the insulating member 1020*a* of the spacer may be: glass whose impurity composition such as Na is reduced, for example, quartz glass; soda lime glass;

and ceramic such as alumina. It is preferable that the thermal expansion factor of the insulating member 1020*a* is approximately that of the material of the air-tight envelope and substrate 1011.

As described earlier, the surface resistance Rs of the charge-up suppressing film 1020*b* is preferably in the range from $10^5$ (Ω/□) to $10^{12}$ (Ω/□), from the viewpoint of maintaining the charge-up suppressing effects and suppressing power consumption by leak current. Various materials described earlier can be used.

The low resistance film 1020*c* has a sufficiently low resistance as compared to the charge-up suppressing film 1020*b*. The material may be selected from: metals such as Ni, Cr, Au, Mo, W, Pt, Ti, Al, Cu, and Pd or alloy thereof; metals and metal oxides such as Pd, Ag, Au, $RuO_2$, and Pd-Ag; printed conductors made of glass and the like; transparent conductors such as $In_2O_3$—$SnO_2$; and semiconductor materials such as polysilicon.

The electroconductive bonding member 1040 electrically connects the spacer 1020 to the row-directional wiring patterns 1013 and to the metal back 1019. The material is preferably electroconductive adhesive, metal particles, or frit glass mixed with electroconductive filler.

Dx1 to Dxm, Dy1 to Dyn, and Hv represent connection terminals of an air tight envelope for electrically connecting the display panel to an unrepresented external electronic circuit. Dx1 to Dxm are electrically connected to the row-directional wiring patterns 1013 of the multi electron beam source, Dy1 to Dyn are electrically connected to the column-directional wiring patterns 1014 of the multi electron beam source, and Hv is electrically connected to the metal back 1019.

In evacuating the inside of the air-tight envelope, after the air-tight envelope is assembled, an unrepresented exhaust pipe and vacuum pump are coupled to evacuate the inside of the air-tight envelope to about $10^{-7}$ Torr. Thereafter, the exhaust pipe is sealed. In this case, in order to maintain a vacuum degree in the inside of the air-tight envelope, a getter film (not shown) is formed at a predetermined position in the air-tight envelope immediately before or after the sealing. The getter film is formed by heating the getter material having, for example, Ba as its main composition, with a heater or through high frequency heating, and vapor evaporating the material. By the absorption function of the getter film, the inside of the air-tight envelope is maintained in a vacuum of $1\times10^{-5}$ to $1\times10^{-7}$ Torr.

With the image forming apparatus using the display panel described above, as a voltage is applied to each cold cathode device 1020 via the external terminals Dx1 to Dxm and Dy1 to Dyn, electrons are emitted from each cold cathode device 1012. At the same time, a high voltage of several hundred V to several kV is applied to the external terminal to accelerate the emitted electrons and collide them with the inner surface of the face plate 1017. Each color fluorescent material constituting the fluorescent film 1018 is excited and radiates light to display an image.

Generally, the voltage applied to the cold cathode device or surface conduction electron-emitting device 1012 is about 12 to 16 V, a distance d between the metal back 1019 and cold cathode device 1012 is about 0.1 mm to 8 mm, and a voltage applied across the metal back 1019 and cold cathode device 1012 is about 0.1 kV to 10 kV.

The outline of the fundamental structure and manufacture method of the display panel of the embodiment as well as the summary of the image forming apparatus have been described above.

(Manufacture Method of Multi Beam Electron Source)

Next, a method of manufacturing a multi beam electron beam source used with the display panel of the embodiment, will be described.

The material, shape, and manufacture of a cold cathode device of the multi electron beam source used by the image forming apparatus of the embodiment are not limited so long as the electron source has cold cathode devices wired in a simple matrix layout. For example, surface conduction electron-emitting devices, FE type or MIM type cold cathode devices may be used.

Of the cold cathode devices, the surface conduction electron-emitting device is particularly preferable if an expensive display apparatus having a large display screen is desired. Specifically, in the FE type, the relative position and shapes of an emitter cone and gate electrode greatly influence the electron emission characteristics and very high precision manufacture techniques are required. This is a disadvantageous factor in realizing a large area screen and a low manufacture cost. In the MIM type, it is necessary for the insulating film and upper electrode to have a thin and uniform film thickness. This is also a disadvantageous factor in realizing a large area screen and a low manufacture cost. In contrast, the surface conduction electron-emitting device is relatively easy to be manufactured and it is easy to realize a large area screen and a low manufacture cost.

The present inventors have found that the surface conduction electron device whose electron emitting-region and its nearby region are made of a fine particle film has excellent electron emitting characteristics and in addition can be manufactured easily. It is therefore most suitable for using it with the multi electron beam source of the image forming apparatus having a high luminance and a large screen. From this reason, the display panel of the embodiment uses the surface conduction electron-emitting device whose electron emitting-region and its nearby region are made of a fine particle film. The fundamental structure, manufacture method, and electron emission characteristics of a preferred surface conduction electron-emitting device will first be described and then the structure of a multi electron beam source with a number of devices wired in a simple matrix layout will be described.

The typical types of the surface conduction electron device whose electron emitting-region and its nearby region are made of a fine particle film are classified into a plane type and a step type.

Figure 8A:
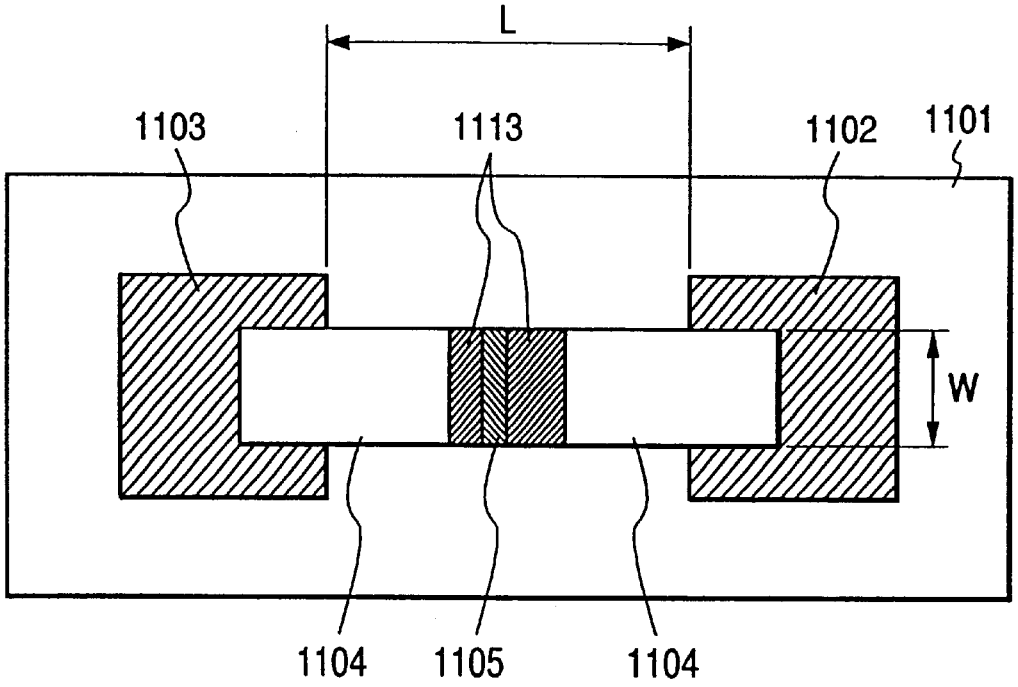
FIGS. 8A and 8B are a schematic plan view and cross sectional view showing the structure of a plane type surface conduction electron-emitting device used by the embodiment of the invention.
Figure 8B:
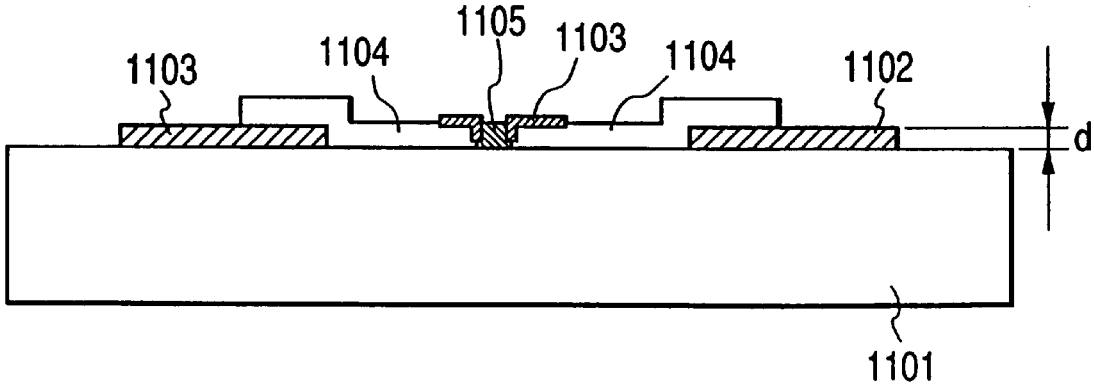

First, the structure and manufacture method of a plane type surface conduction electron-emitting device will be described. FIG. 8A is a plan view of a plane type surface conduction electron-emitting device showing the structure thereof, and FIG. 8B is a cross sectional view thereof. In FIGS. 8A and 8B, reference numeral 1101 represents a substrate, reference numeral 1102 and 1103 represent device electrodes, reference numeral 1104 represents an electroconductive thin film, reference numeral 1105 represents an electron emitting region formed by the energization forming operation, and reference numeral 1113 represents a thin film formed by the energization activation operation.

The substrate 1101 may use: various glass substrates such as quartz glass and soda lime glass; various ceramic substrates such as alumina; these substrates laminated with an insulating film made of $SiO_2$; and the like.

The device electrodes 1102 and 1103 disposed on the substrate 1101 in parallel to the surface thereof are made of electroconductive material including: metals such as Ni, Cr, Au, Mo, W, Pt, Ti, Cu, Pd, and Ag and alloy thereof; metal oxides such as $In_2O_3$—$SnO_2$; and semiconductors such as polysilicon. The device electrode can be formed easily by using a combination of film forming techniques such as vacuum evaporation and patterning techniques such as photolithography and etching. Other methods, for example, printing techniques may also be used.

The shapes of the device electrodes 1102 and 1103 are designed properly in accordance with the application field of the electron-emitting device. Generally, the device electrode space L is designed to have a range from several hundred angstroms to several hundred $\mu$m, or in a range from several number $\mu$m to several ten $\mu$m particularly suitable for the application to a display apparatus. A film thickness d of the device electrodes is selected to be in a range from several hundred angstroms to several number $\mu$m.

The electroconductive film 1104 is made of a fine particle film. The fine particle film is intended herein to mean a film made of a number of fine particles (inclusive of an aggregation of island fine particles). As the fine particle film is observed microscopically, fine particles are distributed in a dispersed manner, disposed adjacent to each other, or superposed upon each other.

The diameter of a fine particle used for the fine particle film is in a range from several angstroms to several thousand angstroms, or more preferably in a range from 10 angstroms to 200 angstroms. The thickness of the fine particle film is set as desired, by taking into account the following conditions including the condition of good electrical connection to the device electrodes 1102 and 1103, the condition of good energization forming operation to be described later, the condition of setting the electric resistance of the fine particle film to a proper value to be described later, and the like. Specifically, the diameter is set in a range from several angstroms to several thousand angstroms, or more preferably in a range from 10 angstroms to 500 angstroms.

The material of the fine particle film may be selected as desired from: metal such as Pd, Pt, Ru, Ag, Au, Ti, In, Cu, Cr, Fe, Zn, Sn, Ta, W, and Pb; oxide such as PdO, $SnO_2$, $In_2O_3$, PbO, and $Sb_2O_3$; boride such as $HfB_2$, $ZrB_2$, $LaB_6$, $CeB_6$, $YB_4$, and $GdB_4$; carbide such as TiC, ZrC, HfC, TaC, SiC, and WC; nitride such as TiN, ZrN, and HfN; semiconductor such as Si and Ge; carbon; and the like.

The sheet resistance of the electroconductive thin film 1104 made of the fine particle film is set in a range from $10^3$ to $10^7$ ($\Omega/\square$).

The electroconductive thin film 1104 and the device electrodes 1102 and 1103 are partially overlapped in order to obtain good electrical connection. In the example shown in FIGS. 8A and 8B, although the substrate, device electrodes, and electroconductive thin film are stacked from the bottom, the substrate, electroconductive thin film, and device electrodes may be stacked in this order from the bottom.

The electron-emitting region 1105 is a region of fissures partially formed in the electroconductive thin film 1104, and has a higher resistance than the nearby electroconductive thin film. The fissures are formed by subjecting the electroconductive thin film 1104 to an energization forming operation to be later described. Fine particles having a diameter of several angstroms to several hundred angstroms are formed in the fissures in some cases. Since it is difficult to draw the shape and position of an actual electron-emitting region, they are schematically shown in FIGS. 8A and 8B.

A thin film 1113 is made of carbon or carbon compound and covers the electron-emitting region 1105 and its nearby area. The thin film 1113 is formed by performing after the energization forming operation an energization activation operation to be described later. The thin film 1113 is made of single crystal graphite, polycrystalline graphite, amorphous graphite, or mixture thereof. The film thickness is set to 500 angstroms or thinner, or more preferably 300 angstroms or thinner. Since it is difficult to draw the shape and position of an actual thin film 1113, they are schematically shown in FIGS. 8A and 8B.

The preferred fundamental structure has been described. In this embodiment, the following components were used.

Soda lime glass was used as the material of the substrate 1101, and the device electrodes 1102 and 1103 were made of an Ni thin film. The thickness d of the device electrode was set to 1000 angstroms, and a distance L between the device electrodes was set to 2 $\mu$m. Pd or PdO was used as the main material of the fine particle film, the thickness of the fine particle film was set to about 100 angstroms, and the width W thereof was set to 100 $\mu$m.

(Manufacture Method of Plane Type Surface Conduction Electron-emitting Device)

Next, a preferred method of manufacturing a plane type surface conduction electron-emitting device will be described. FIGS. 9A to 9D are cross sectional views illustrating the method of manufacturing a plane type surface conduction electron-emitting device. In FIGS. 9A to 9D, like elements to those shown in FIGS. 8A and 8B are represented by using identical reference numerals.

Figure 9A:
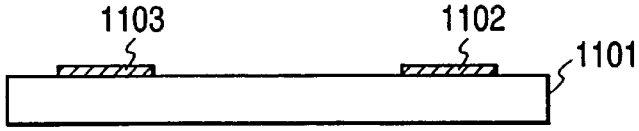
FIGS. 9A, 9B, 9C, 9D and 9E are schematic cross sectional views of a plane type surface conduction electron-emitting device illustrating the manufacture processes thereof.

1) First, as shown in FIG. 9A, the device electrodes 1102 and 1103 are formed on the substrate 1101. Before the material of the device electrodes is deposited, the substrate 1101 is fully cleaned with rinsing liquid, pure water, organic solvent or the like. The device electrode material is deposited through vacuum film forming techniques such as vacuum evaporation and sputtering. The deposited device electrode material is patterned through photolithography to form a pair of device electrodes 1102 and 1103 shown in FIG. 9A.

Figure 9B:
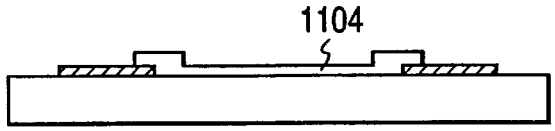

2) Next, as shown in FIG. 9B, the electroconductive thin film 1104 is formed. This electroconductive thin film 1104 is formed by coating organic metal solution on the substrate, drying it, thermally curing it to form the fine particle film, and thereafter patterning it to a desired shape through photolithography and etching. The organic metal solution may be a solution of organic metal compound containing as its main element the material of fine particles used by the electroconductive thin film. In this embodiment, Pd was used as the main element. In this embodiment, although dipping is used as the coating method, other methods such as spinner method and spraying method may also be used. Although the electroconductive thin film made of the fine particle film is formed by coating organic metal solution in this embodiment, it may be formed by vacuum evaporation, sputtering, or chemical vapor deposition.

Figure 9C:
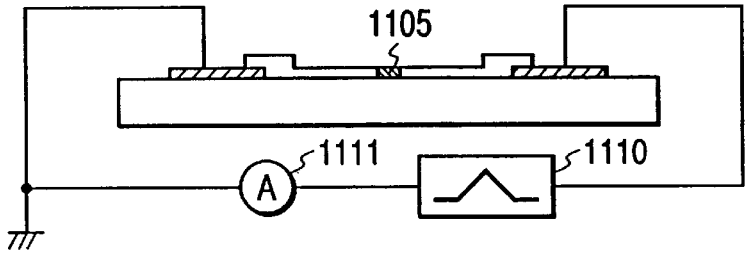

3) Next, as shown in FIG. 9C, a proper voltage is applied across the device electrodes 1102 and 1103 from a forming power source 1110 to perform the energization forming operation and form the electron-emitting region 1105.

The energization forming operation is an operation of applying a voltage to the electroconductive thin film 1104 of the fine particle film, locally breaking, deforming, or decomposing to form a structure suitable for emitting electrons. The changed structure (electron-emitting region 1105) of the electroconductive thin film of the fine particle film suitable for emitting electrons is formed with proper fissures in the thin film. The electrical resistance between the device electrodes 1102 and 1103 after the electron-emitting region 1105 is formed increases considerably as compared to that before it is formed.

Figure 10:
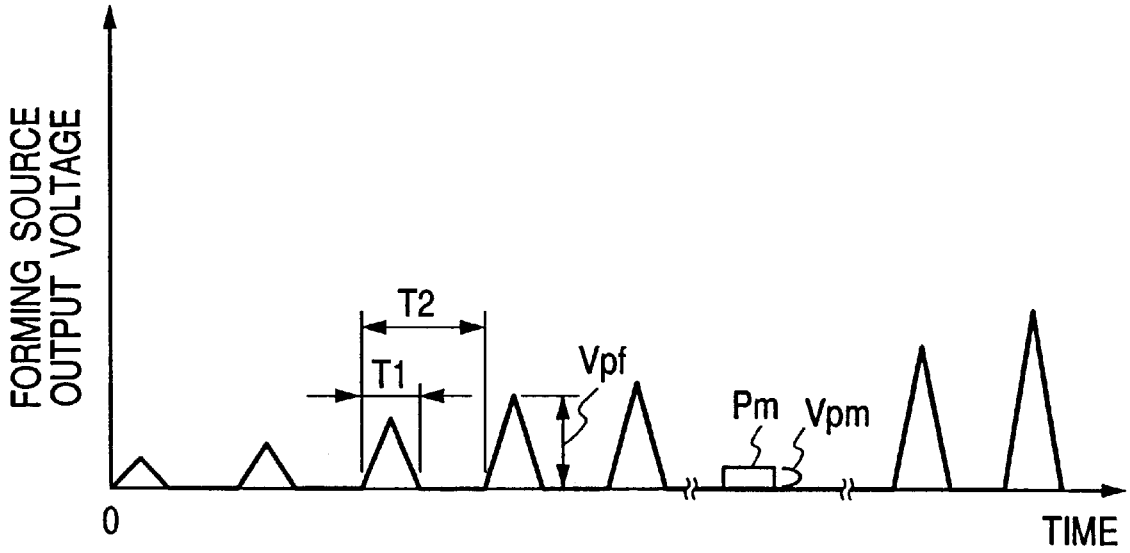
FIG. 10 shows voltage waveforms applied during an energization forming operation.

The energization method will be described in more detail. FIG. 10 shows examples of waveforms of a voltage to be applied from the forming power source 1110. A pulse voltage is preferable for subjecting the electroconductive thin film of the fine particle film to the forming operation. In this embodiment, a triangular pulse voltage having a pulse width W such as shown in FIG. 10 was sequentially applied at an interval T2, while a peak value Vpf of the triangular pulse voltage was gradually raised. In order to monitor the state of the electron-emitting region 1105, a monitor pulse Pm was inserted between the triangular pulses at a desired interval and current was measured with an ammeter 1111.

In this embodiment, in a vacuum atmosphere of about $10^{-5}$ Torr, the pulse width T1 was set to 1 msec, the pulse interval T2 was set to 10 msec, and the peak value Vpf was raised 0.1 V per one pulse. Each time five triangular pulses were applied, one monitor pulse Pm was inserted. In order to prevent the forming operation from being adversely affected, the monitor pulse voltage Vpm was set to 0.1 V. The forming operation was terminated when the electric resistance between the device electrodes 1102 and 1103 reached $1\times10^{6}$ Ω, i.e., when the current measured with the ammeter 1111 upon application of the monitor pulse reached $1\times10^{-7}$ A or smaller.

This method is preferable for the surface conduction electron-emitting device of this embodiment. It is preferable to change the energization conditions when the design of the surface conduction electron-emitting device, such as the film thickness of the fine particle film and the device electrode distance L, is changed.

Figure 9D:
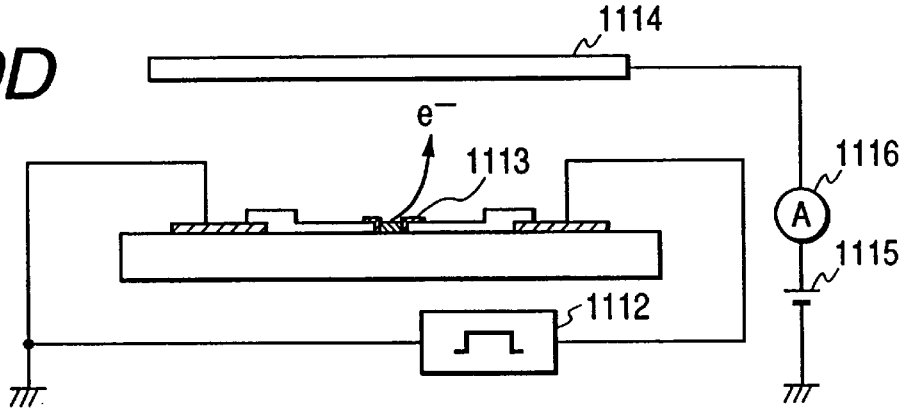

4) Next, as shown in FIG. 9D, a proper voltage is applied across the device electrodes 1102 and 1103 from an activation power source 1112 to perform the energization activation operation and improve the electron emission characteristics.

The energization activation operation is an operation of applying a proper voltage to the electron-emitting region formed by the energization forming operation to deposit carbons or carbon compounds near the electron-emitting region 1105. In FIG. 9D, deposited substances made of carbons or carbon compounds are schematically shown as a member 1113.

As compared to the state before the energization activation operation, the emission current at the same applied voltage can be increased typically by a hundredfold or more. Specifically, in a vacuum atmosphere of $10^{-4}$ to $10^{-5}$ Torr, a pulse voltage is periodically applied to deposit carbons or carbon compounds produced from organic compounds existing in the vacuum atmosphere. The deposited substances 1113 are made of single crystal graphite, polycrystalline graphite, amorphous carbon, or mixture thereof, and the film thickness is 500 angstroms or thinner, or more preferably 300 angstroms or thinner.

Figure 11A:
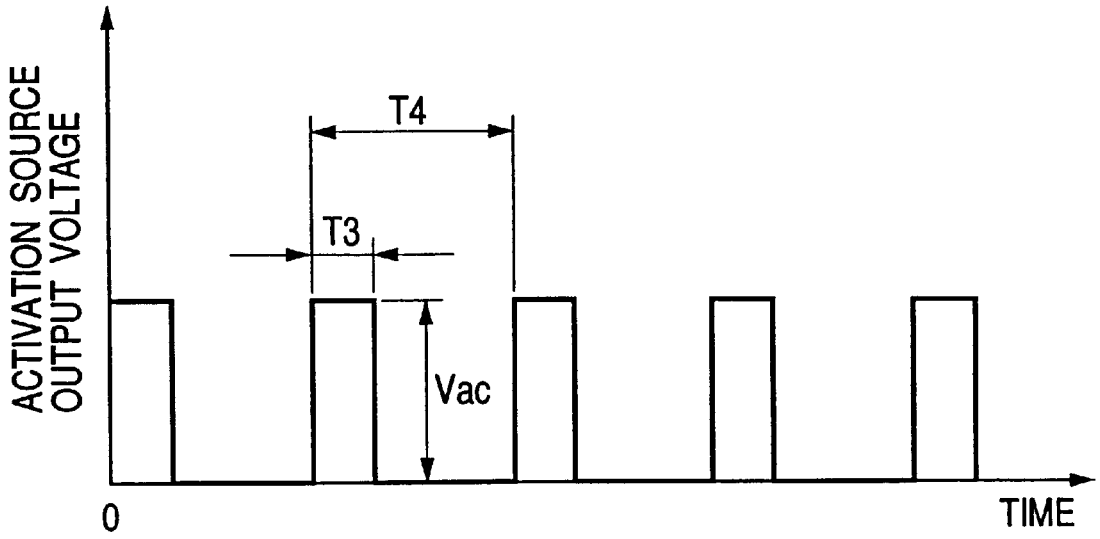
FIG. 11A shows voltage waveforms applied during the energization activation operation and FIG. 11B shows a change in an emission current Ie.

The energization method will be described in more detail. FIG. 11A shows examples of waveforms of a voltage to be applied from the activation power source 1112. In this embodiment, a constant rectangular pulse voltage was periodically applied to perform the energization activation operation. Specifically, the rectangular voltage Vac was set to 14 V, the pulse width T3 was set to 1 msec, and the pulse interval T4 was set to 10 msec. The energization conditions described above are preferable for the surface conduction electron-emitting device of this embodiment. It is preferable to change the energization conditions if a design of the surface conduction electron-emitting device is changed.

Figure 11B:
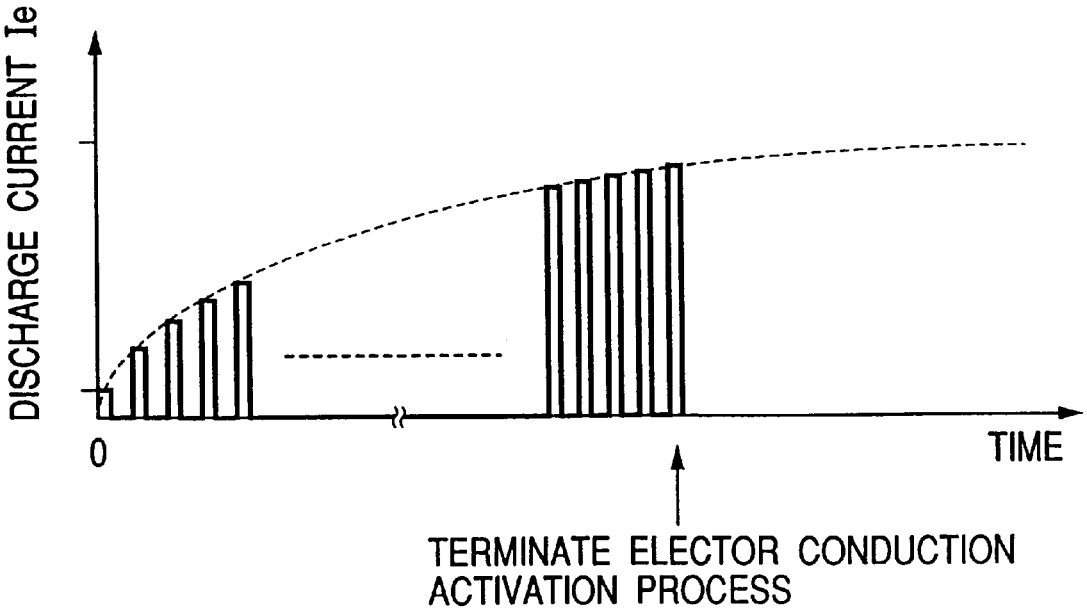

Reference numeral 1114 shown in FIG. 9D represents an anode electrode for capturing electrons emitted from the surface conduction electron-emitting device. A d.c. high voltage power source 1115 and an ammeter 1116 are connected to the anode electrode 1114. If the activation operation is performed after the substrate 1101 is assembled in the display panel, the fluorescent plane of the display panel is used as the anode electrode 1114. While a voltage is applied from the activation power source 1112, the emission current Ie is measured with the ammeter 1116 to monitor the advance state of the energization activation operation and regulate the activation power source 1112. An example of the emission current Ie measured with the ammeter 1116 is shown in FIG. 11B. As the pulse voltage is applied from the activation power source 1112, the emission current Ie increases as the time lapses until it saturates and increases hardly. When the emission current Ie becomes generally saturated, the voltage application from the activation power source is stopped to terminate the energization activation operation.

The energization conditions described above are preferable for the surface conduction electron-emitting device of this embodiment. It is preferable to change the energization conditions if a design of the surface conduction electron-emitting device is changed.

Figure 9E:
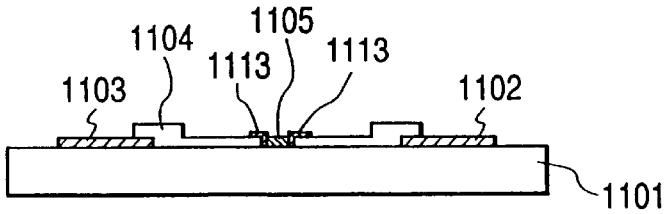

The flat type surface conduction electron-emitting device shown in FIG. 9E was manufactured in the above manner.

[Manufacture Method of Step Type Surface Conduction Electron-emitting Device]

Next, the structure of a step type surface conduction electron-emitting device will be described which is another typical structure of the surface conduction electron-emitting device having the fine particle film constituting the electron-emitting region and its nearby region.

Figure 12:
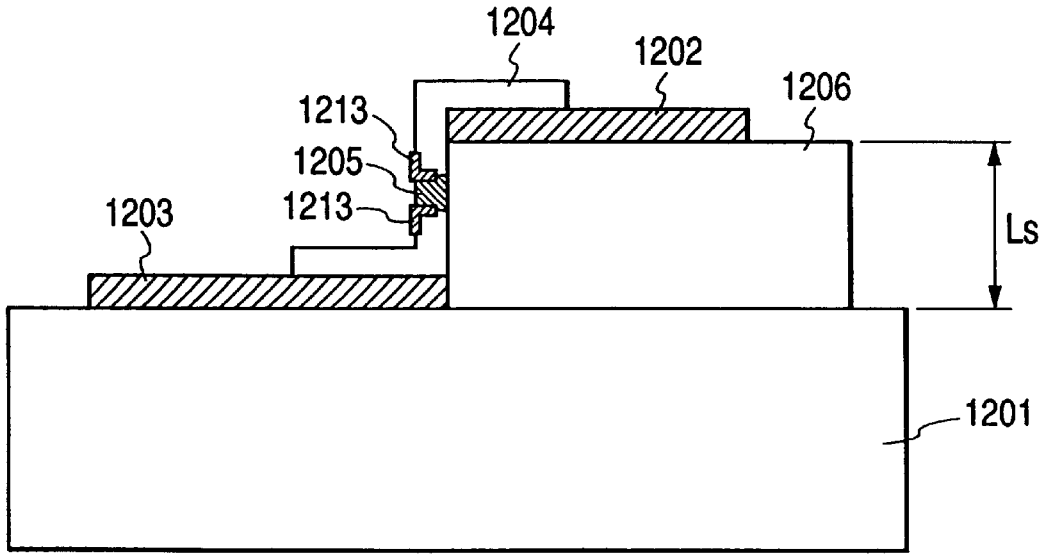
FIG. 12 is a cross sectional view of a step type surface conduction electron-emitting device used by the embodiment of the invention.

FIG. 12 is a schematic cross sectional view showing the fundamental structure of the step type. In FIG. 12, reference numeral 1201 represents a substrate, reference numerals 1202 and 1203 represent device electrodes, reference numeral 1206 represents a step forming member, reference numeral 1204 represents an electroconductive thin film made of a fine particle film, reference numeral 1205 represents an electron emitting region formed by the energization forming operation, and reference numeral 1213 represents a thin film formed after the energization activation operation.

Different points of the step type from the plane type described above reside in that one 1202 of the two device electrodes is formed on the step forming member 1206 and the electroconductive thin film 1204 covers the side wall of the step forming member 1206. The device electrode distance L of the plane type shown in FIGS. 8A and 8B corresponds to a step height Ls of the step forming member 1205 of the step type. The substrate 1201, device electrodes 1202 and 1203, and electroconductive thin film 1204 made of the fine particle film can be formed by using the same materials as those of the plane type surface conduction electron-emitting device described above. The step forming member 1206 may be made of electrically insulating material such as $SiO_2$.

Next, a method of manufacturing a step type surface conduction electron-emitting device will be described. FIGS. 13A to 13F are cross sectional views illustrating the manufacture method. In FIGS. 13A to 13F, like elements to those shown in FIG. 12 are represented by using identical reference numerals.

Figure 13A:
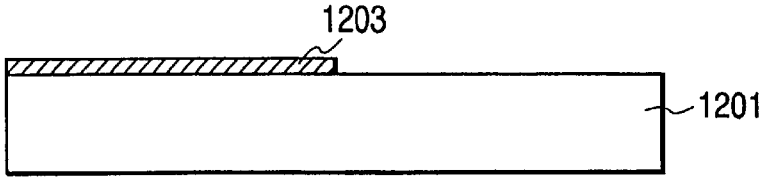
FIGS. 13A, 13B, 13C, 13D, 13E and 13F are schematic cross sectional views of a step type surface conduction electron-emitting device illustrating the manufacture processes thereof.

1) First, as shown in FIG. 13A, the device electrodes 1203 is formed on the substrate 1201.

Figure 13B:
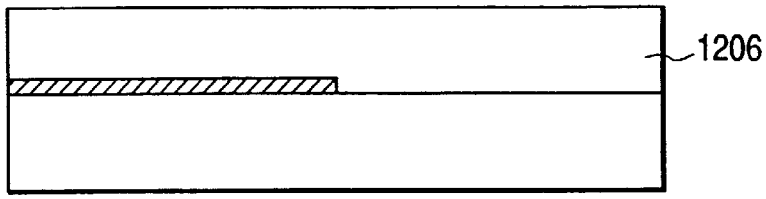

2) Next, as shown in FIG. 13B, an insulating layer for forming the step forming member is deposited. The insulating layer may be deposited by sputtering $SiO_2$. Other film forming methods such as vacuum evaporation or printing may also be used.

Figure 13C:
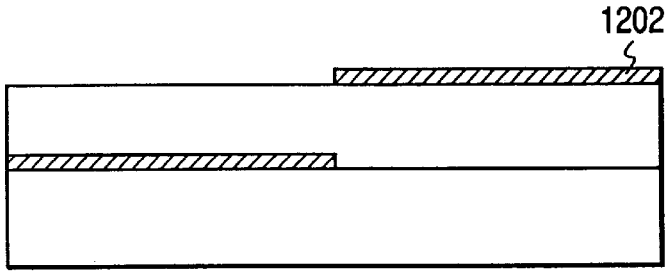

3) Next, as shown in FIG. 13C, the device electrode 1202 is formed on the insulating layer.

Figure 13D:
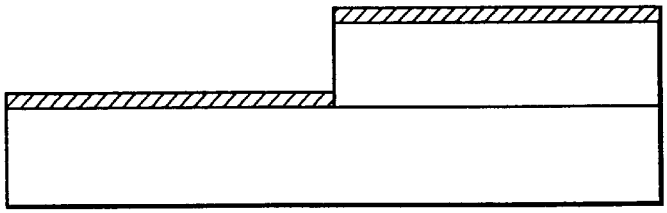

4) Next, as shown in FIG. 13D, the insulating layer is partially etched and removed to expose the device electrode 1203.

Figure 13E:
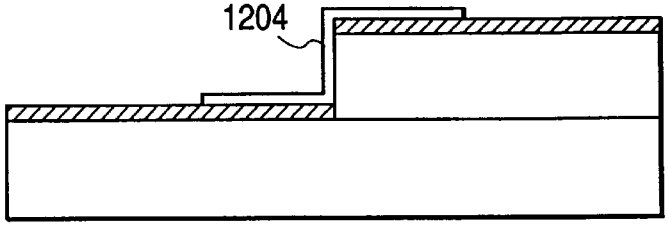

5) Next, as shown in FIG. 13E, the electroconductive thin film 1204 made of the fine particle film is formed by a film forming method such as coating similar to the plane type.

6) Next, similar to the plane type, the energization forming operation is performed to form the electron-emitting region. The energization forming operation is performed in the manner similar to the energization forming operation for the plane type described with reference to FIG. 9C.

7) Next, similar to the plane type, the energization activation operation is performed to deposit carbons or carbon compounds on the electron-emitting region and its nearby region. The energization activation operation is performed in the manner similar to the energization activation operation for the plane type described with reference to FIG. 9D.

Figure 13F:
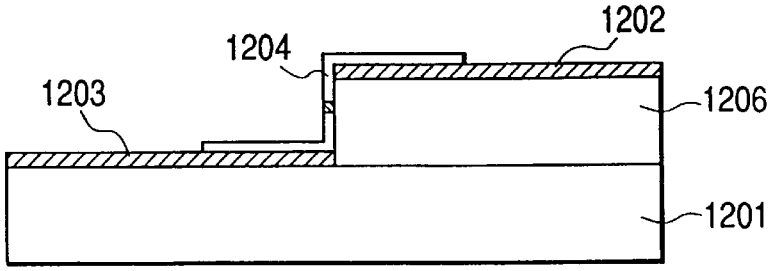

The step type surface conduction electron-emitting device shown in FIG. 13F was manufactured in the above manner.

(Characteristics of Surface Conduction Electron-emitting Device)

The device structure and manufacture method of the plane/step type surface conduction electron-emitting device has been described above. Next, the characteristics of the device used with the image forming apparatus will be described.

Figure 14:
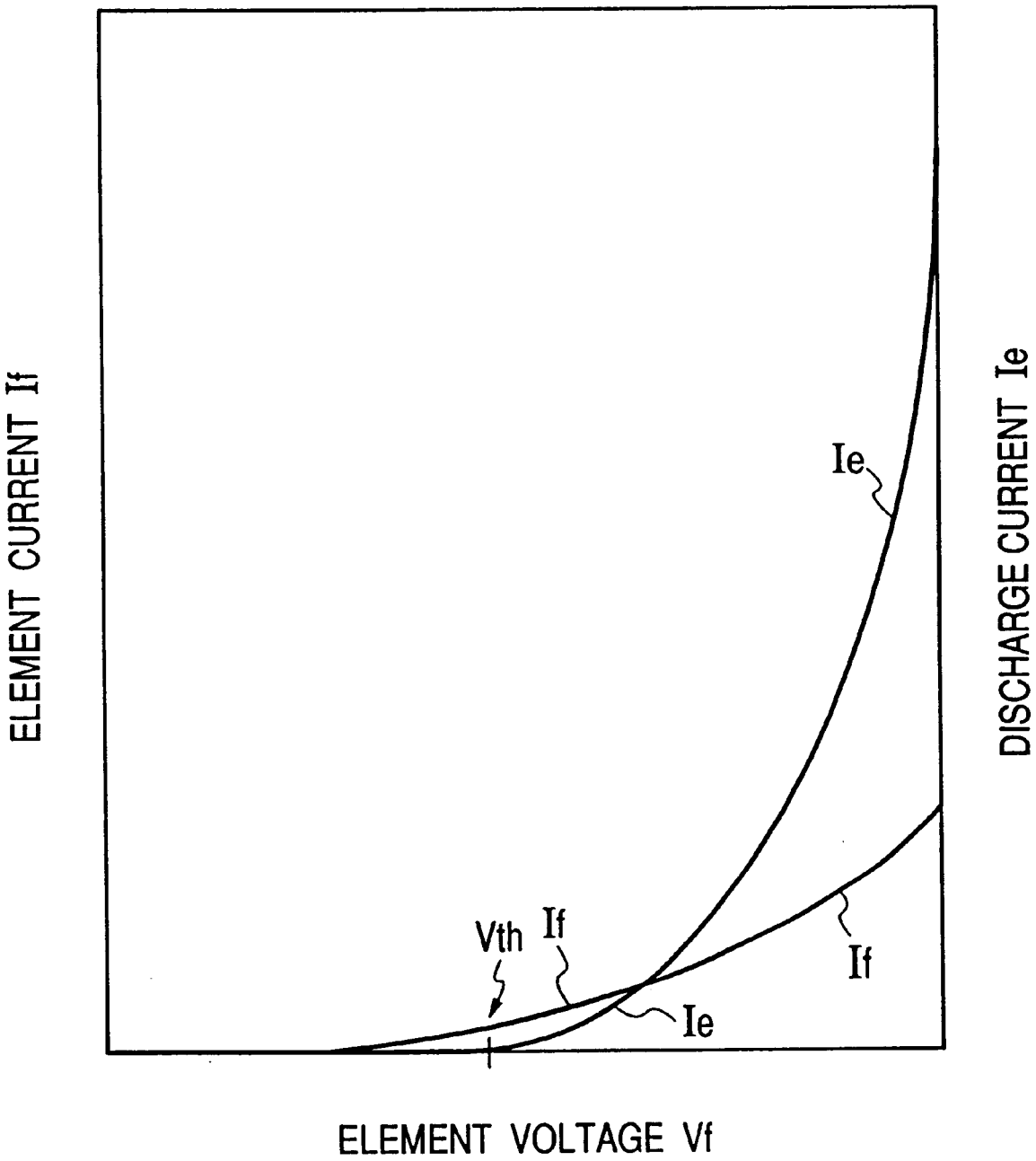
FIG. 14 is a graph showing typical characteristics of a surface conduction electron-emitting device used by the embodiment of the invention.

FIG. 14 is a graph showing typical examples of the characteristics of the emission current Ie relative to the device application voltage Vf and the characteristics of the device current If relative to the device application voltage, respectively of the device used with the display panel. In FIG. 14, since the emission current Ie is considerably smaller than the device current If, it is difficult to show both the currents by the same scale and also the characteristics change depending upon design parameters such as the dimension, shape, and the like. Therefore, they are indicated by arbitrary scales.

The emission current Ie of the device used with the image forming apparatus has the following three characteristic features:

(i) If a voltage equal to or larger than a certain voltage (called a threshold voltage Vth) is applied to the device, the emission current Ie increases abruptly, whereas if a voltage lower than the threshold value Vth is applied, the emission current hardly flows. Namely, the device is a non-linear device that the emission current Ie has the threshold value (Vth) relative to Vf.

(ii) Since the emission current Ie changes with the voltage Vf applied to the device, the emission current Ie can be controlled by the device voltage Vf.

(iii) Since a response time of the emission current Ie of the device upon application of the device voltage Vf is short, the charge amount of electrons emitted from the device can be controlled in accordance with the application time duration of the device voltage Vf.

Since the device has the above characteristic features, the surface conduction electron-emitting device can be effectively used with the image forming apparatus. For example, in an image forming apparatus having a number of devices corresponding to the pixels of the display screen, an image can be displayed by sequentially scanning the devices by utilizing the above characteristic feature (i).

Specifically, a voltage equal to or higher than the threshold voltage Vth is applied to the device to be driven, in accordance with a desired luminance, and a voltage lower than the threshold voltage Vth is applied to the devices not to be driven. By sequentially changing the devices to be driven, an image can be displayed.

By utilizing the second or third characteristic feature (ii) or (iii), the luminance can be controlled so that the gradation display is possible.

(Structure of Multi Beam Electron Source)

Next, the structure of a multi electron beam source having the surface conduction electron-emitting devices disposed on the substrate and wired in a simple matrix layout will be described.

Figure 15:
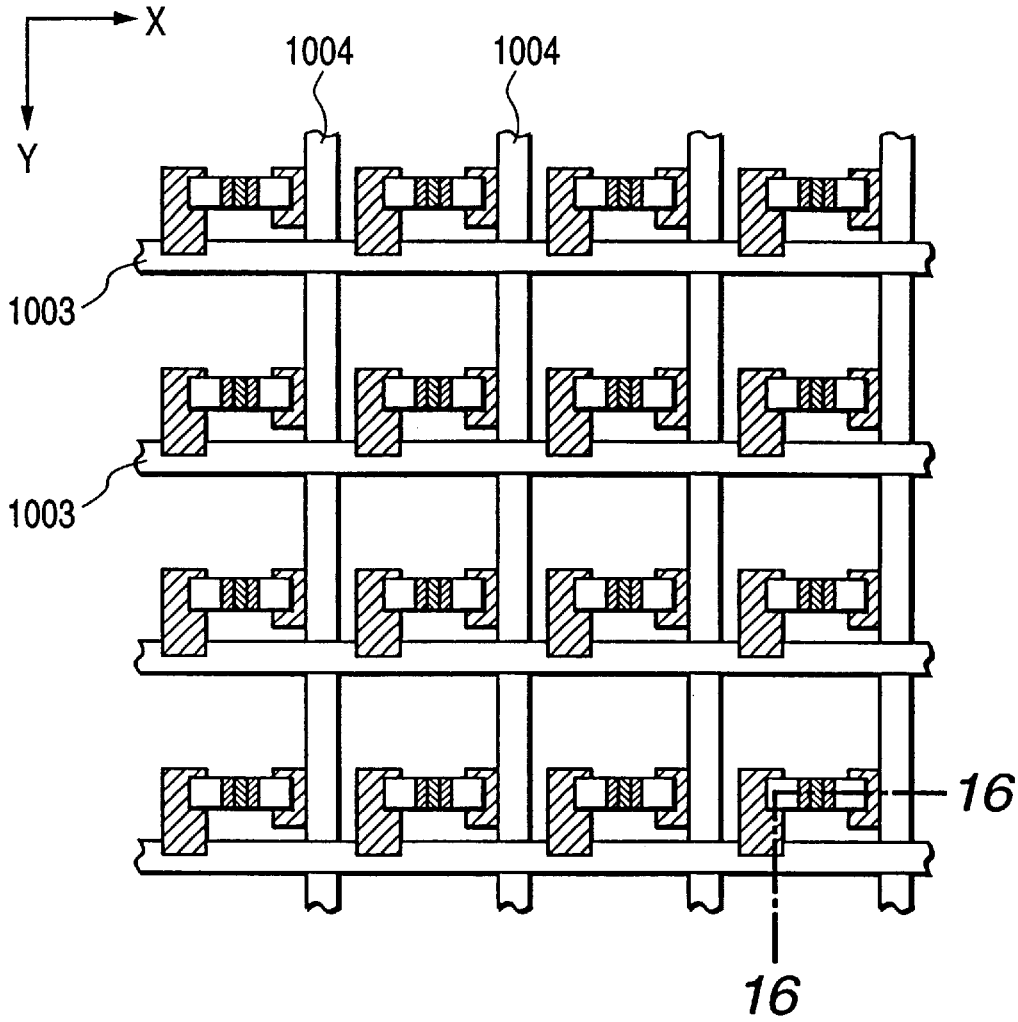
FIG. 15 is a plan view of a substrate of a multi electron beam source used by the embodiment of the invention.

FIG. 15 is a plan view of a multi electron beam source used with the display panel shown in FIG. 4. Surface conduction electron-emitting devices similar to that shown in FIGS. 8A and 8B are disposed on a substrate and wired in a simple matrix layout to row- and column-directional wiring patterns 1003 and 1004. An insulating layer (not shown) is formed in the cross area between the row- and column-directional wiring patterns 1003 and 1004 to electrically insulating the wiring patterns.

Figure 16:
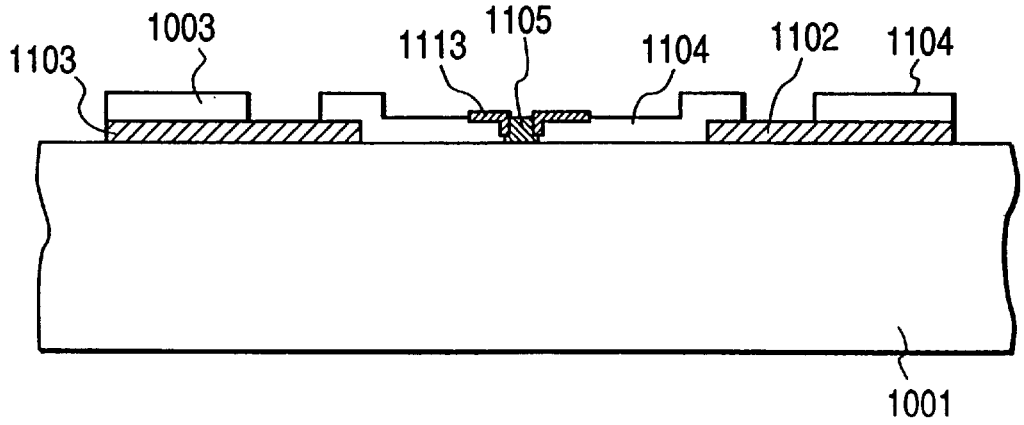
FIG. 16 is a partial cross sectional view of the substrate of the multi electron beam source used by the embodiment of the invention.

FIG. 16 is a cross sectional view taken along line 16—16 of FIG. 15. The multi electron beam source was manufactured by forming on the substrate the row- and column-directional wiring patterns 1003 and 1004, interelectrode insulating layer (not shown), device electrodes 1102 and 1103 and electroconductive thin film 1104 of each surface conduction electron-emitting device, and thereafter supplying a power to each device via the row- and column-directional wiring patterns 1003 and 1004 to perform the energization forming and activation operations.

Figure 17:
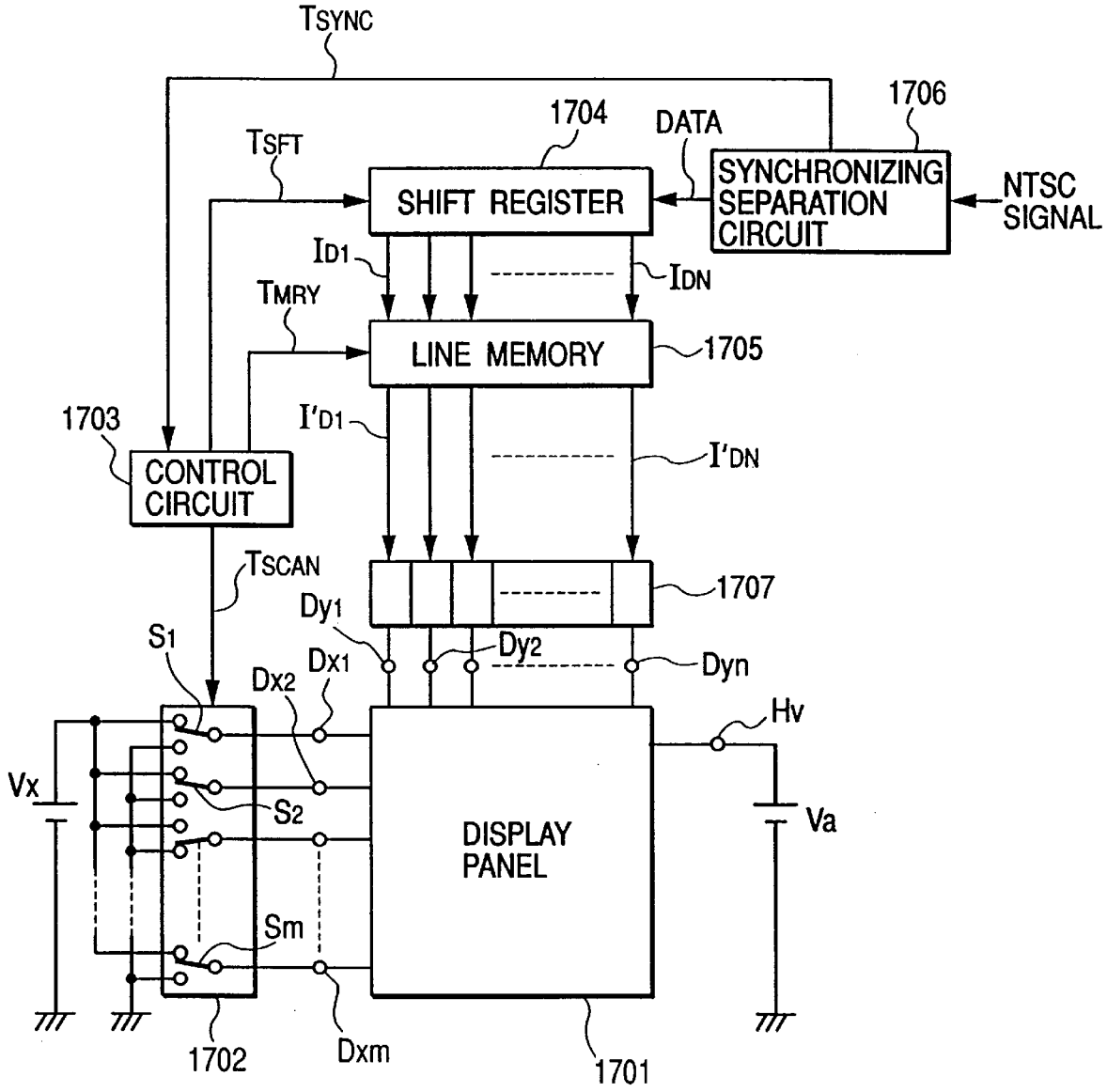
FIG. 17 is a block diagram showing the outline structure of a driver circuit of the image forming apparatus according to the embodiment of the invention.

FIG. 17 is a block diagram showing the outline structure of a driver circuit for displaying NTSC television signals.

In FIG. 17, a display panel 1701 is manufactured and operates in the manner described above. A scan circuit 1702 scans a display line, and a control circuit 1703 generates signals to be input to the scan circuit. A shift register 1704 shifts data of each line, and a line memory 1705 inputs the data of one line supplied from the shift register 1704. A sync signal separation circuit 1706 separates a sync signal from an NTSC signal.

The function of each element of the driver circuit shown in FIG. 17 will be detailed. The display panel 1701 is connected to an external electronic circuit via terminals Dx1 to Dxm, terminals Dy1 to Dyn, and a high voltage terminal Hv. A scan signal is sequentially applied to the terminals Dx1 to Dxm to drive the multi electron beam source in the display panel 1701, i.e., the surface conduction electron-emitting devices matrix-wired in an m rows×n columns one row (n devices) after another.

A modulation signal is applied to the terminals Dy1 to Dyn to control an output electron beam of each device of one-row n surface conduction electron-emitting devices selected by the scan signal. A d.c. voltage of, for example, 5 kV, is applied from a d.c. voltage source Va to the high voltage terminal Hv. This d.c. voltage is an acceleration voltage for imparting an energy sufficient for exciting the fluorescent material, to the electron beam radiated from the multi electron beam source.

The scan circuit 102 will be described. The scan circuit 102 has m switching elements (S1 to Sm schematically shown in FIG. 17). Each switching element selects either an output voltage from a d.c. voltage source Vx or 0 V (ground level), and is electrically connected to a corresponding one of the terminals Dx1 to Dxm of the display panel 1701. Each switching element S1 to Sm operates in response to a control signal Tscan output from the control circuit 1703, and may be constituted of an FET switching element, for example.

The d.c. voltage source Vx is designed to output a constant voltage, in accordance with the characteristics of an electron-emitting device such as shown in FIG. 14, so that a drive voltage applied to a device not scanned becomes the threshold voltage or lower.

The control circuit 1703 has a function of controlling each circuit so that a proper image can be displayed in accordance with an externally input image signal. The control circuit 103 supplies control signals such as Tscn, Tsft, and Tmry to each circuit synchronously with the sync signal Tsync supplied from the sync separation circuit 1706.

The sync separation circuit 1706 derives sync signal components and luminance signal components from an externally input NTSC television signal, and may be constituted of a general frequency separation (filter) circuit. Although the sync signal separated by the sync separation circuit 1706 consists of a vertical sync signal and a horizontal sync signal, they are collectively shown as the Tsync signal in FIG. 17 for the convenience of description. The luminance signal components separated from the television signal are represented by a DATA signal also for the convenience of description. The DATA signal is supplied to the shift register 1704.

The shift register 1704 performs a serial/parallel conversion of the DATA signal input time sequentially and serially into parallel signals of each line of the image, and operates in response to the control signal Tsft supplied from the control circuit 1703. Namely, the control signal Tsft is used as a shift clock of the shift register 1704. The serial/parallel converted data (corresponding to the drive data for the n surface conduction electron-emitting devices) of one line of the image is output from the shift register 1704 as n parallel signals Id1 to Idn.

The line memory 1705 stores data of one line during a necessary time, i.e., stores the contents of Id1 to Idn, in response to the control signal Tmry supplied from the control circuit 1703. The stored contents are output to the modulation signal generator 1707 as signals Id'1 to Id'n.

The modulation signal generator 1707 generates a signal for driving and modulating each of the surface conduction electron-emitting devices in accordance with the image data Id'1 to Id'n. The output signals are applied via the terminals Dy1 to Dyn to the surface conduction electron-emitting devices of the display panel 1701.

As described earlier with reference to the graph of FIG. 14, the surface conduction electron-emitting device has the following fundamental features with respect the emission current Ie.

Specifically, electron emission is associated with a definite threshold voltage Vth (8 V in the case of a surface conduction electron-emitting device of an embodiment to be described later), and occurs only when a voltage of Vth or higher is applied. In a range of the voltage of Vth or higher, an emission current changes in accordance with the device voltage as shown in the graph of FIG. 14. Therefore, for example, in applying a pulse voltage to the device, if a voltage not higher than the electron emission threshold voltage is applied, electron emission does not occur, whereas if a voltage not lower than the electron emission threshold voltage is applied, an electron beam is radiated from the surface conduction electron-emitting device. In this case, the intensity of the output electron beam can be controlled by changing the pulse peak voltage Vm. The total amount of charges of the output electron beam can be controlled by changing the pulse width Pw.

Accordingly, as a method of modulating an electron-emitting device in accordance with an input signal, a voltage modulation method, a pulse width modulation method, and the like can be adopted.

For the voltage modulation method, a voltage modulation circuit can be used as the modulation signal generator 1707 in which circuit a voltage pulse of a constant duration is generated and the peak value of a pulse is modulated by input data.

For the pulse width modulation method, a pulse width modulation circuit can be used as the modulation signal generator 1707 in which a voltage pulse of a constant peak value is generated and the pulse width is modulated by input data. The shift register 1704 and line memory 1705 may be either a digital signal type or an analog signal type, so long as the serial/parallel conversion and storage of an image signal can be performed in a predetermined process time.

If the digital signal type is used, it is necessary to convert the DATA signal output from the sync signal separation circuit 1706 into digital signals. To this end, an A/D converter is provided at the output of the sync signal separation circuit 1706. The modulation signal generator 1707 is changed slightly in accordance with whether the output signal of the line memory 1705 is a digital signal or an analog signal. Specifically, for the voltage modulation method using a digital signal, the modulation signal generator 1707 is additionally provided with, for example, a D/A converter and an amplifier circuit if necessary.

For the pulse width modulation method, the modulation signal generator 1707 is replaced by, for example, a high speed oscillator, a counter for counting a wave number of an output of the oscillator, and a comparator for comparing an output of the counter with an output of the line memory 1705. If necessary, an amplifier may be added for voltage-amplifying the pulse width modulated signal output from the comparator up to a drive voltage of a surface conduction electron-emitting device.

For the voltage modulation method using an analog signal, for example, an amplifier such as an operation amplifier is used as the modulation signal generator 1707, and if necessary, a level shift circuit is added. For the pulse width modulation method, for example, a voltage controlled oscillator (VCO) is used as the modulation signal generator 1707, and if necessary, an amplifier is added for voltage-amplifying an output of VCO up to a drive voltage of a surface conduction electron-emitting device.

In the image forming apparatus applicable to the invention and constructed as above, electron emission occurs when voltages are applied to each electron-emitting device via corresponding ones of the external terminals Dx1 to Dxm and Dy1 to Dyn. The electron beam is accelerated by applying a high voltage to the metal back 1019 or transparent electrode (not shown) via the high voltage terminal Hv. The accelerated electrons collide with the fluorescent film 1018 which emits light and forms an image.

The structure of the image forming apparatus described above is only one example of an image forming apparatus applicable to the invention. Various modifications are therefore possible based upon the technical concept of the invention. Instead of an NTSC input signal, other television signals may also be used, such as PAL, SECAM, and television signals (MUSE, and HDTV) having a number of scan lines larger than PAL and SECAM.

Figure 18A:
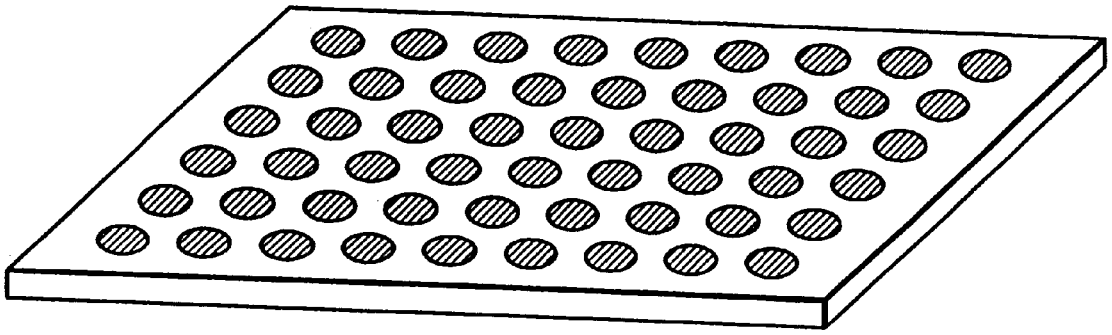
FIGS. 18A and 18B are perspective views showing spacers usable by the embodiment of the invention.
Figure 18B:
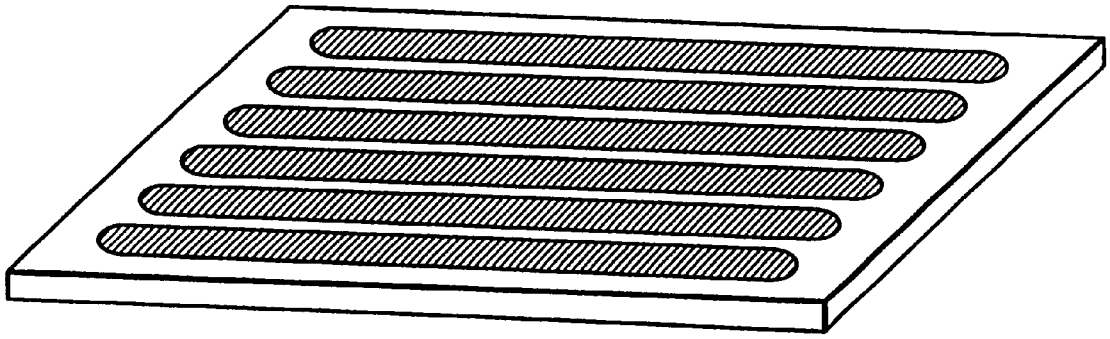

In the embodiment, the spacer has a thin plate shape. Other shapes may also be used such as a cross shape, an L-character shape, a comb shape, a honey-comb shape with circular holes formed on a substrate each being provided with the electron-emitting device as shown in FIG. 18A, and a stripe shape with stripe openings formed through a substrate each being provided with a plurality of electron-emitting devices shown in FIG. 18B. Use of the spacers 1020 covered with the charge-up suppressing film provides the more advantageous effects the larger the image forming apparatus is.

The embodiments will be described more specifically.

In each of the embodiment described hereinunder, the multi electron beam source was used in which n×m (n=3072 and m=1024) surface conduction electron-emitting devices of the above-described type having the electron-emitting region in the electroconductive fine particle film between the device electrodes were wired in a matrix layout (refer to FIGS. 4 and 15) to the m row-directional wiring patterns and n column-directional wiring patterns.

In the first embodiment, the display panel having the spacers 1020 shown in FIG. 4 was manufactured. The details will be given with reference to FIGS. 4, 6, and 7.

First, the substrate 1011 formed with the row- and column-directional wiring electrodes 1013 and 1014, device electrodes and electroconductive thin film of each surface conduction electron-emitting device, was fixed to the rear plate 1015. Next, the semiconductor film 1020*b* and carbon 1020*d* to be described later were formed on the four surfaces, exposed in the air-tight enveloper, of the insulating member 1020*a* made of soda lime glass. The spacers 1020 (height of 5 mm, thickness of 200 μm, length of 20 mm) formed with the electroconductive films on joint surfaces were fixed to the substrate 1011 at the same pitch with, and in parallel to, the row-directional wiring patterns 1013. Thereafter, the face plate 1017 having the fluorescent film 1018 and metal back 1019 on the inner surface side thereof was mounted 5 mm above the substrate 1011 by using the wide wall 1016. Junction sides of the rear plate 1015, face plate 1017, side wall 1010, and spacers 1020 were fixed together. Frit glass (not shown) was coated on the junctions between the substrate 1011 and rear plate 1015, between the rear plate 1015 and side wall 1016, and between the face plate 1017 and side wall 1016, and cured in the atmospheric air for 10 minutes or longer at 400 to 500° C. to seal the display panel.

The spacer 1020 was adhered to the row-directional wiring 1013 (line width of 300 μm) on the side of the substrate 1011, and to the metal back 1019 on the side of the face plate 1017, by using electroconductive frit glass (not shown) mixed with electroconductive filler or conductive material such as metal. At the same time when the air-tight envelope was sealed, it was cured in the atmospheric air for 10 minutes or longer at 400 to 500° C. to provide the spacer 1020 with bonding and electrical connection. In this embodiment, the fluorescent film 1018 adopted the stripe shape that each color fluorescent material 21*a* extended in the column direction (Y direction) as shown in FIG. 19 and the black color conductive member 21*b* was disposed not only between respective color fluorescent materials (R, G, B) 21*a* but also between pixels in the Y direction. The spacers 1020 were disposed in the area corresponding to each black conductive member 21*b* (line width of 300 μm) parallel to the row direction (X direction), relative to the metal back 1019. In performing the above sealing, it is necessary to make each color fluorescent material 21*a* correspond to each device on the substrate 1011, so that precise position alignment was given to the rear plate 1015, face plate 1017 and spacers 1020.

The inside of the air-tight envelope completed in the above manner was evacuated with a vacuum pump via an exhaust pipe (not shown) to a sufficient vacuum degree. Thereafter, a power was supplied to each device via the external terminals Dx1 to Dxm and Dy1 to Dyn and row- and column-directional wiring electrodes 1013 and 1014 to perform the energization forming and activation operations and manufacture the multi electron beam source.

Next, at a vacuum degree of about $10^{-6}$ Torr, the unrepresented exhaust pipe was heated and melted with a gas burner to seal the envelope (air-tight container). Lastly, a getter process was performed to maintain the vacuum degree after the sealing.

The spacer 1020 disposed in the display panel was manufactured in the following manner. The semiconductor film 1020*b* made of a Cr—Al alloy nitride film having a layer dispersed with carbons was formed on the four surfaces, exposed in the air-tight envelope, of the insulating member 1020*a* made of soda lime glass. The electroconductive film 1020*c* was formed on the junction surfaces to complete the spacer 1020. The Cr—Al alloy nitride film was formed by sputtering Cr and Al targets by using a high frequency power source. The sputter gas was a mixture gas of $Ar:N_2$=7:3 and had a total pressure of $4\times10^{-3}$ Torr. The high frequency powers applied to the Cr and Al targets were set to 13 W and 500 W, respectively, to form the alloy nitride film having a desired specific resistance. In a Cr concentration range from 1 to 3 atom %, the film having a specific resistance of $5\times10^4$ to $3\times10^5$ Ωcm was obtained. After the Cr—Al alloy nitride film having the film thickness of 190 nm and the surface resistance of Rs=$3\times10^9$ Ω was formed, a C target was sputtered by using the high frequency power source and a sputter gas of $Ar:H_2$=7:3 to form island carbons having a thickness of 2 nm. The total pressure of $Ar+H_2$ was set to $4\times10^{-3}$ Torr. Thereafter, the Cr and Al targets were again sputtered by using a mixture gas of $Ar:N_2$=7:3, a total pressure of $4\times10^{-3}$ Torr, and the high frequency power source to form island Cr—Al alloy nitrides having a thickness of 2 nm. As above, the Cr—Al alloy nitride film having dispersed carbons and a film thickness of 20 nm was formed by alternately performing sputtering with the C target and sputtering with the Cr and Al target, by using the high frequency power source.

Samples of the spacers were subjected to a heat treatment at 425° C. and a heat treatment at 200° C. in a vacuum state, and the resistance values thereof were measured. The resistance values were uniform. Namely, since the charge-up suppressing film has a small change in the resistance value even after the heat treatments, this spacer is particularly effective for use in the environment of a vacuum state like the electron beam display panel, or for the manufacture processes including a high temperature heat treatment and a vacuum heat treatment.

Next, as the low resistance film 1020, a Pt film of a stripe shape having a width of 30 μm and a thickness of 0.1 μm was formed at junctions between the spacer and the face plate and rear plate.

In the image displaying apparatus having the spacers manufactured in the above manner assembled in the display panel shown in FIGS. 4, 6, and 7, a scan signal and modulation signal were applied from an unrepresented signal generator circuit to each cold cathode device (surface conduction electron-emitting device) 1012 via the external terminals Dx1 to Dxm and Dy1 to Dyn, and at the same time a high voltage Va was applied to the metal back 1019 via the high voltage terminal Hv, to thereby emit electrons and accelerate them to collide them with the fluorescent film 1018. Each color fluorescent material (R, G, B in FIG. 19) was therefore excited to radiate light and display an image. The voltage applied to the high voltage terminal Hv was 3 kV to 10 kV, and the voltage Vf applied to each wiring pattern 1013 and 1014 was 14 V.

Trains of radiated light spots including light spots produced by electrons emitted near to the spacer 1020 from the cold cathode device 1012 were formed two dimensionally at an equal pitch and a clear color image with good color reproductivity was able to be displayed. This implied that a disturbance of an electric field which adversely affected the electron trajectories did not occur.

Second Embodiment

This embodiment is similar to the first embodiment except that the charge-up suppressing film of the spacer 1020 disposed in the display panel has island carbons deposited on the semiconductor film of the Cr—Al alloy nitride film. In the second embodiment, after the Cr—Al alloy nitride film was formed to a thickness of 90 nm under the same conditions as the first embodiment, a C target was sputtered by using the sputter gas of $Ar:H_2=7:3$ at a total pressure of $4\times10^{-3}$ Torr and a high frequency power source to form island carbons having a thickness of 10 nm. Samples of the spacers were subjected to a heat treatment at 425° C. and a heat treatment at 200° C. in a vacuum state, and the resistance values thereof were measured. The resistance values were uniform. Namely, since the charge-up suppressing film has a small change in the resistance value even after the heat treatments, this spacer is particularly effective for use in the environment of a vacuum state like the electron beam display panel, or for the manufacture processes including a high temperature heat treatment and a vacuum heat treatment. An image was displayed under the conditions similar to the first embodiment. Trains of radiated light spots including light spots produced by electrons emitted near to the spacer 1020 from the cold cathode device 1012 were formed two dimensionally at an equal pitch and a clear color image with good color reproductivity was able to be displayed.

Third Embodiment

This embodiment is similar to the first embodiment except that the charge-up suppressing film of the spacer 1020 disposed in the display panel has island carbons deposited on the semiconductor film of the Cr—Al alloy nitride film having a layer dispersed with carbons.

In the third embodiment, after the Cr—Al alloy nitride film was formed to a thickness of 180 nm under the same conditions as the first embodiment, a C target was sputtered by using the sputter gas of $Ar:H_2=7:3$ at a total pressure of $4\times10^{-3}$ Torr and a high frequency power source to form island carbons having a thickness of 2 nm. Thereafter, Cr and Al targets were sputtered at the same time by using the sputter gas of $Ar:H_2=7:3$ at a total pressure of $4\times10^{-3}$ Torr and the high frequency power source to form island Cr—Al alloy nitrides having a thickness of 2 nm. As above, the Cr—Al alloy nitride film having dispersed carbons and a film thickness of 200 nm was formed by alternately performing sputtering with the C target and sputtering with the Cr and Al target, by using the high frequency power source.

A C target was further sputtered by using the sputter gas of $Ar:H_2=7:3$ at a total pressure of $4\times10^{-3}$ Torr and the high frequency power source to form island carbons having a thickness of 10 nm on the surface of the semiconductor film. Samples of the spacers were subjected to a heat treatment at 425° C. and a heat treatment at 200° C. in a vacuum state, and the resistance values thereof were measured. The resistance values were uniform. Namely, since the charge-up suppressing film has a small change in the resistance value even after the heat treatments, this spacer is particularly effective for use in the environment of a vacuum state like the electron beam display panel, or for the manufacture processes including a high temperature heat treatment and a vacuum heat treatment. An image was displayed under the conditions similar to the first embodiment. Trains of radiated light spots including light spots produced by electrons emitted near to the spacer 1020 from the cold cathode device 1012 were formed two dimensionally at an equal pitch and a clear color image with good color reproductivity was able to be displayed.

Fourth Embodiment

This embodiment is similar to the second embodiment except that plasma CVD is used for forming island carbons in place of sputtering. An amorphous carbon film having a thickness of 2 nm was formed on the Cr—Al alloy nitride film through plasma CVD by using methane gas diluted with $H_2$ as the source material.

Samples of the spacers were subjected to a heat treatment at 425° C. and a heat treatment at 200° C. in a vacuum state, and the resistance values thereof were measured. The resistance values were uniform. Namely, since the charge-up suppressing film has a small change in the resistance value even after the heat treatments, this spacer is particularly effective for use in the environment of a vacuum state like the electron beam display panel, or for the manufacture processes including a high temperature heat treatment and a vacuum heat treatment.

Trains of radiated light spots including light spots produced by electrons emitted near to the spacer 1020 from the cold cathode device 1012 were formed two dimensionally at an equal pitch and a clear color image with good color reproductivity was able to be displayed.

In the first to fourth embodiments, a spacer used by an electron beam apparatus is covered with a charge-up suppressing film having dispersed and deposited carbons. Therefore, a stable high resistance value can be obtained, and generation of secondary electrons to be caused by radiation of an electron beam can be prevented. Further, since the high resistance film is made of an island film or a very thin film, a variation of resistances can be suppressed to the degree that charges can be removed in the in-plane of the high resistance film.

Since an image forming apparatus using a highly stable spacer charge-up suppressing film can be provided, a fluctuation of an image can be prevented and an image of good image quality can be formed.

In the embodiments to be described later, a second film not made of carbons is used.

Figure 24:
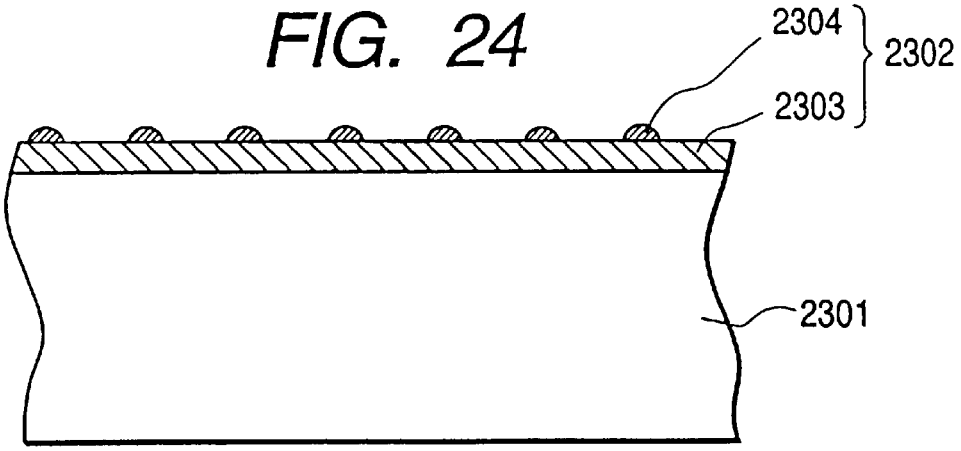
FIG. 24 is a schematic diagram showing a charge-up suppressing film according to an embodiment of the invention.

FIG. 24 is a schematic cross sectional view of the charge-up suppressing film of the embodiments. Reference numeral 2301 represents an insulating member to be provided with an antistatic function, and reference numeral 2302 represents an antistatic film formed on the surface of the insulating member 2301. The antistatic film 2302 is constituted of a high resistance thin film 2303 and discrete island particles 2304 formed on the surface of the high resistance thin film 2303.

Figure 25:
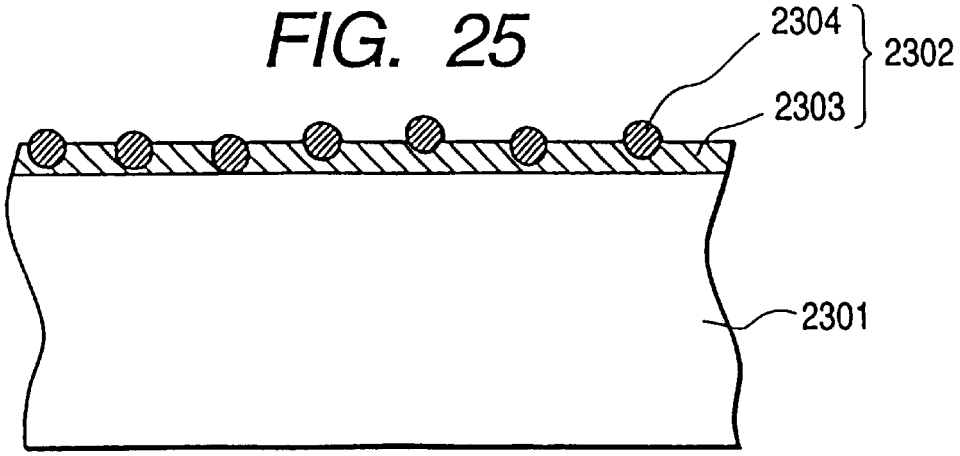
FIG. 25 is a schematic diagram showing a charge-up suppressing film according to another embodiment of the invention.
Figure 23:
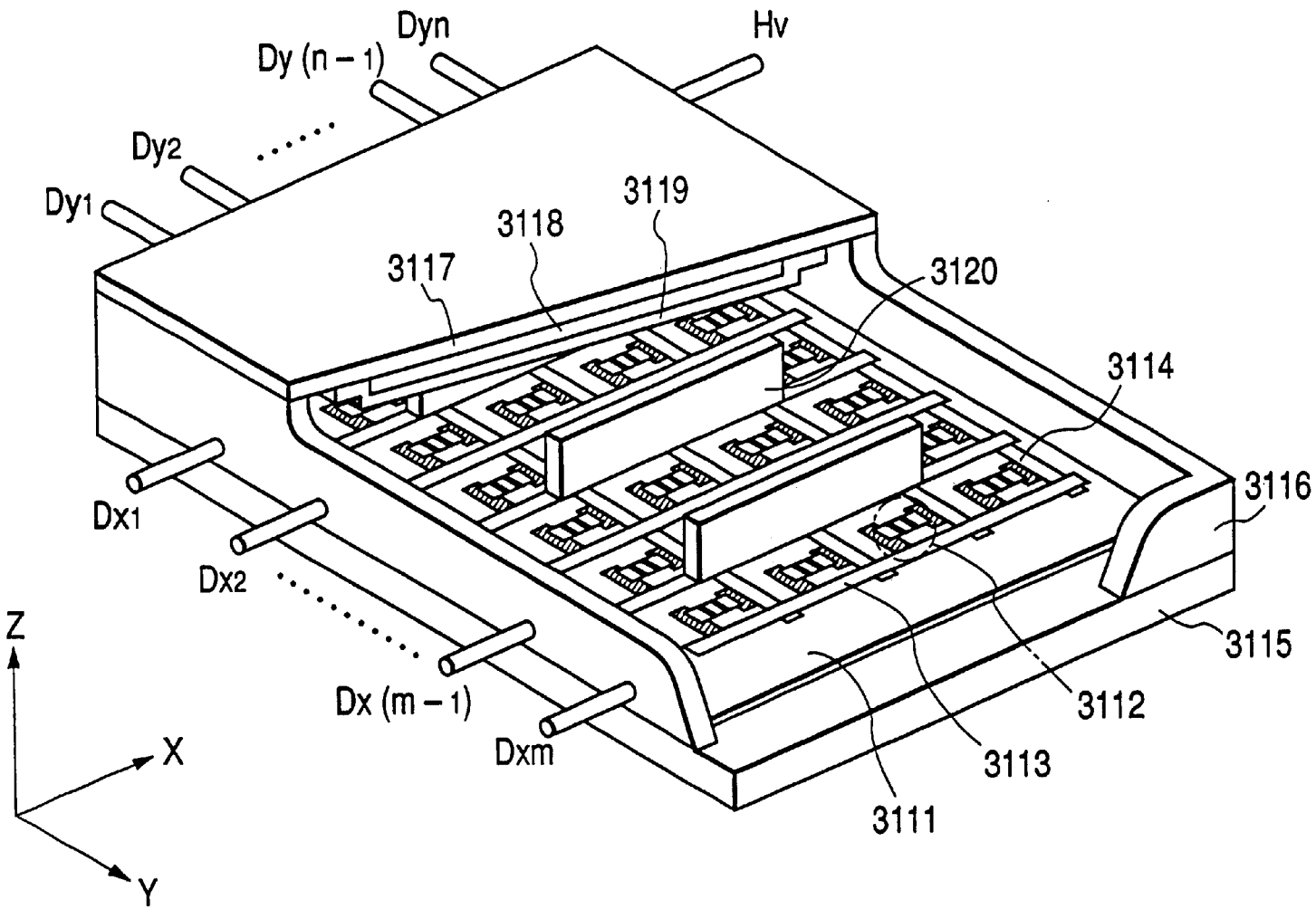
FIG. 23 is a partially broken perspective view showing a display panel of an image forming apparatus.

FIG. 25 is a schematic cross sectional view showing another structure of the charge-up suppressing film. The charge-up suppressing film 2302 is constituted of a high resistance thin film 2303 and discrete island particles 2304, similar to the structure shown in FIG. 24. However, the particles 2304 are embedded in the high resistance thin film 2303, and the partial surface thereof are exposed above the high resistance thin film 2303.

(Material of Island Electroconductive Particles)

Each of the discrete island particles formed on the surface of the charge-up suppressing film is desired to have a high conductivity and to be made of a material having a secondary electron emission coefficient smaller than the charge-up suppressing film, because the spacer becomes hard to be charged even if electrons emitted from the electron-emitting device collide with the spacer. Such a material may be: metals or alloys thereof such as Be, Mg, Al, Ti, Ni, Cs, Ba, Pt, Au, Ag, Rh, Ir, Sb, Sn, Pb, Ga, Zn, In, Cd, Cu, Co, Fe, Mn, Cr, V, Zr, Nb, Mo, and W; oxide such as $SnO_2$; and sulfide such as $MoS_2$ and $WS_2$.

(Method of Forming Island Electroconductive Particles)

Discrete island particles formed in or on the high resistance charge-up suppressing film can be formed on the insulating member by thin film forming methods such as sputtering, reactive sputtering, electron beam vacuum evaporation, ion plating, ion assist vacuum evaporation, and CVD.

Fifth Embodiment

In this embodiment, as the substrate for the charge-up suppressing film, a soda lime glass having a 500 nm thick silicon nitride film formed on the surface thereof through sputtering was used. This substrate is insulative.

On this insulating member, a high resistance thin film was deposited to form a Cr—Al alloy nitride film. The high resistance thin film was formed by sputtering Cr and Al targets at the same time. The sputter gas was $Ar:N_2=7:3$ and its total pressure was 4 mTorr. By regulating the high frequency power for the Cr and Al targets, the alloy nitride film having 5.8% of Cr and a specific resistance of $10^8$ Ωcm was obtained.

In the above manner, the Cr—Al alloy nitride film as the high resistance film was formed, which had a specific resistance of $5\times10^5$ Ωcm and a film thickness of 200 nm.

Next, island Al was formed on the surface of this film through sputtering to obtain a sample A.

In order to deposit island Al, sputtering was performed during a time at a power both shorter and lower than normal sputtering. In this manner, island Al electroconductive particles was able to be formed, such as schematically shown in FIG. 24.

In order to deposit Al particles partially embedded in the film, the reverse sputtering (for the substrate side) was performed and thereafter sputtering was performed during a short time at a lower power while the substrate was heated.

In order to deposit not only island particles but also a thin Al island film, the sputtering was performed during a time at a power both shorter and lower than normal sputtering, and at a sputter gas pressure larger than normal sputtering.

Sixth Embodiment

On the insulating member similar to the fifth embodiment, a Cr—Al alloy nitride film having a specific resistance of $5\times10^5$ Ωcm and a film thickness of 200 nm was formed under the same conditions as the fifth embodiment. Next, island Ni particles were formed through sputtering on the surface of the Cr—Al alloy nitride film to obtain a sample B.

In order to deposit island Ni, sputtering was performed during a time at a power both shorter and lower than normal sputtering. In this manner, island Ni electroconductive particles was able to be formed, such as schematically shown in FIG. 24.

Seventh Embodiment

On the insulating member similar to the fifth embodiment, a Cr—Al alloy nitride film having a specific resistance of $5\times10^5$ Ωcm and a film thickness of 200 nm was formed under the same conditions as the fifth embodiment.

Next, island Mo particles were formed through argon plasma sputtering on the surface of the Cr—Al alloy nitride film to obtain a sample C.

In order to deposit island Mo, sputtering was performed in the manner similar to the fifth embodiment to obtain island Mo electroconductive particles such as shown in FIG. 24.

Eighth Embodiment

In place of Cr of the fifth embodiment, a Ti target was used to form a Ti—Al alloy nitride film of 60 nm in thickness on an alumina substrate. The sputter gas same as the fifth embodiment was used. By regulating the high frequency powers for Ti and Al, an alloy nitride film having a specific resistance of $6\times10^4$ Ωcm was formed. By using the same process system as the alloy nitride film, island Ti was formed in succession on the surface of the alloy nitride film to obtain a sample D.

In order to deposit island Ti, sputtering was performed in the manner similar to the fifth embodiment to obtain island Ti electroconductive particles such as shown in FIG. 24.

Ninth Embodiment

In place of Cr of the fifth embodiment, a Ta target was used to form a Ti—Al alloy nitride film of 80 nm in thickness on a quartz glass substrate. The sputter gas same as the fifth embodiment was used. By regulating the high frequency powers for Ti and Al, an alloy nitride film having a specific resistance of $3\times10^3$ Ωcm was formed. Island Ta was formed on the surface of the alloy nitride film through argon plasma sputtering to obtain a sample E.

In order to deposit island Ta, sputtering was performed in the manner similar to the fifth embodiment to obtain island Ta electroconductive particles such as shown in FIG. 24.

Tenth Embodiment (High Resistance Film)

Cr and Al targets were sputtered at the same time by using a high frequency power source to form a Cr—Al alloy nitride film. The sputter gas used was a mixture gas of $Ar:N_2=1:2$ and its total pressure was 1 mTorr. Soda lime glass was used as the insulating member. By regulating the high frequency powers for the Cr and Al targets, the specific resistance of the alloy nitride film was changed. The specific resistance was $4.0\times10^5$ Ωcm at the Cr concentration of 5.8 atom %. On the surface of this Cr—Al alloy nitride film having a thickness of 200 nm, a Pt film of 1 nm in thickness was formed in succession by using the same film forming system as used for the alloy nitride film to obtain a sample F. This film was observed with an SEM and it was confirmed that a discontinuous island film of Pt was formed.

Eleventh Embodiment (High Resistance Film)

In place of Cr used in the tenth embodiment, a Ta target was used to form a Ta—Al alloy nitride film of 200 nm in thickness on soda lime glass. The sputter gas used was the same gas as the tenth embodiment. By regulating the high frequency powers for the Ta and Al targets, the alloy nitride film having the specific resistance of $3.0\times10^5$ Ωcm at the Ta concentration of 31 atom % was obtained. On the surface of this alloy nitride film, an Au film of 1 nm in thickness was formed through electron beam vapor evacuation to obtain a sample G. This film was observed with an SEM and it was confirmed that a discontinuous island film similar to the tenth embodiment was formed.

The above samples A to G were subjected to a heat treatment at 425° C. and a heat treatment at 200° C. in a vacuum state, and the resistance values thereof were measured. The resistance values of the charge-up suppressing films were uniform with less change.

Namely, since the charge-up suppressing film has a small change in the resistance value even after the heat treatments, this spacer is particularly effective for use in the environment of a vacuum state like the electron beam display panel, or for the manufacture processes including a high temperature heat treatment and a vacuum heat treatment.

Twelfth Embodiment

On the surface of glass made of the same material as the rear plate and having a length of 20 mm, a width of 5 mm, and a thickness of 0.2 mm, a silicon nitride film was formed to a thickness of 0.5 μm by sputtering, and this substrate was used as the insulating member.

As the charge-up suppressing film, the 200 nm thick Cr—Al alloy nitride film formed with island Al used in the fifth embodiment was used.

As the low resistance film 1020*c* (in FIG. 7), an Au film of a stripe shape having a width of 30 μm and a thickness of 0.1 μm was formed at junctions between the spacer and the face plate and rear plate. The spacer was adhered between the X-direction wiring pattern and the metal back of the face plate, with electroconductive frit glass. The electroconductive frit glass used was frit glass mixed with conductive fine particles whose surfaces were plated with gold, and the charge-up suppressing film on the spacer surface was electrically connected to the X-direction wiring pattern and the face plate.

Also in this embodiment, the multi electron beam source was used in which m×n (m=1024, n=3072) surface conduction electron-emitting devices having the electron-emitting region in the fine particle film between the device electrodes were wired in a matrix layout to the m row direction wiring patterns and n column direction wiring patterns.

Also in the charge-up suppressing films of the fifth to twelfth embodiments, sufficient charge-up suppressing effects were obtained and the stability was high, by forming a high resistance film on the surface of the insulating member and dispersing discrete island electroconductive particles.

By applying the charge-up suppressing film to the spacer surface for supporting the inner space of an image displaying apparatus, a disturbance of an electron beam near at the spacer can be suppressed, and a displacement between the position where an electron beam collides with the fluorescent material and the position of the actual fluorescent material can be suppressed. It is therefore possible to avoid a luminance loss and manufacture a display apparatus capable of displaying a clear image.

Namely, since the charge-up suppressing film has a small change in the resistance value even after the heat treatments, this spacer is particularly effective for use in the environment of a vacuum state like the electron beam display panel, or for the manufacture processes including a high temperature heat treatment and a vacuum heat treatment.

Thirteenth Embodiment

A film of the spacer formed to partially expose the surface of the underlying film may be made of various materials in addition to those materials described in the above embodiments.

In this embodiment, as the spacer substrate, soda lime glass was used. A silicon nitride film of 0.5 μm in thickness was formed as an Na block layer on the spacer substrate.

On the silicon nitride film, a Ti—Al nitride film was formed as the first film having a conductivity.

Specifically, Ti and Al targets were sputtered at the same time in an atmosphere of a mixture gas of argon and nitrogen. The thickness of the Ti—Al nitride film was set to 200 nm. On the Ti—Al nitride film, a Ti—Al nitride film was formed as a second film, in the manner similar to the first film. The second film was made to have a sufficiently high resistance by adjusting the ratio of Ti. The second film was formed very thin and partially formed to partially expose the underlying first film.

The film forming time was controlled to make the second film have a thickness of about 0.5 nm.

The charge-up suppressing effects were also confirmed by using the spacer of this embodiment.

Fourteenth Embodiment

A film of the spacer formed to partially expose the surface of the underlying film may be made of various materials in addition to those materials described in the above embodiments.

In this embodiment, as the spacer substrate, soda lime glass was used. A silicon nitride film of 0.5 μm in thickness was formed as an Na block layer on the spacer substrate.

On the silicon nitride film, a Ti—Al nitride film was formed as the first film having a conductivity.

Specifically, Ti and Al targets were sputtered at the same time in an atmosphere of a mixture gas of argon and nitrogen. The thickness of the Ti—Al nitride film was set to 200 nm. On the Ti—Al nitride film, a silicon nitride film was formed as a second film, in the manner similar to the first film. The second film was formed very thin and partially formed to partially expose the underlying first film.

The film forming time was controlled to make the second film have a thickness of about 0.5 nm.

The charge-up suppressing effects were also confirmed by using the spacer of this embodiment.

As described in the foregoing, according to the present invention, by depositing materials on the surface of the first film to partially expose the first film, the charge-up suppressing effects can be obtained.

By applying the present invention to a spacer or a frame of an image displaying apparatus, the image displaying apparatus having very good characteristics can be obtained.

Further, in the second film of the spacer, carbon nitride may be used, with regard to a spacer comprising the first film which is electroconductive and a second film containing at least carbon nitride, a structure and a producing method of it are described in U.S. patent application Ser. No. 09/127,586, and have been incorporated into the present application. Even though the layer containing the carbon nitride is used as the second film of the spacer, since the thickness of the second film is reduced, the underlying first film which is electroconductive is exposed partially.

What is claimed is:

1. An electron beam apparatus comprising:

an electron source;

a radiative member on which electrons emitted from said electron source are irradiated; and a third member provided between said electron source and said radiative member, said third member comprising an electroconductive first member and a second member formed on said first member in a dispersed manner to partially expose said first member.

2. An electron beam apparatus according to claim 1, wherein said third member is a support member for supporting said electron source or a first substrate formed with said electron source and said radiative member or a second substrate formed with said radiative member.

3. An image forming apparatus comprising:

an electron source;

an image forming member for forming an image based on electrons emitted from said electron source; and a third member provided between said electron source and said image forming member, said third member comprising an electroconductive first member and a second member formed on said first member in a dispersed manner to partially expose said first member.

4. An image forming apparatus according to claim 3, wherein said third member is a support member for supporting said electron source or a first substrate formed with said electron source and said image forming member or a second substrate formed with said image forming member.

5. An electron beam apparatus comprising:

an electron source;

a radiative member on which electrons emitted from said electron source are radiated; and a third member provided between said electron source and said radiative member, said third member comprising an electroconductive first member and a second member formed on said first member to partially expose said first member, wherein said second member has a thickness of 1 nm to 10 nm.

6. An electron beam apparatus according to claim 5, wherein said third member is a support member for supporting said electron source or a first substrate formed with said electron source and said radiative member or a second substrate formed with said radiative member.

7. An image forming apparatus comprising:

an electron source;

an image forming member for forming an image based on electrons emitted from said electron source; and a third member provided between said electron source and said image forming member, said third member comprising an electroconductive first member and a second member formed on said first member to partially expose said first member, wherein said second member has a thickness of 1 nm to 10 nm.

8. An image forming apparatus according to claim 7, wherein said third member is a support member for supporting said electron source or a first substrate formed with said electron source and said image forming member or a second substrate formed with said image forming member.

9. An electron beam apparatus comprising:

an electron source;

a radiative member on which electrons emitted from said electron source are radiated; and a third member provided between said electron source and said radiative member, said third member comprising an electroconductive first member and a second member formed on said first member to partially expose said first member, wherein said second member is made of carbon.

10. An electron beam apparatus according to claim 9, wherein said third member is a support member for supporting said electron source or a first substrate formed with said electron source and said radiative member or a second substrate formed with said radiative member.

11. An image forming apparatus comprising:

an electron source;

an image forming member for forming an image based on electrons emitted from said electron source; and a third member provided between said electron source and said image forming member, said third member comprising an electroconductive first member and a second member formed on said first member to partially expose said first member, wherein said second member is made of carbon.

12. An image forming apparatus according to claim 11, wherein said third member is a support member for supporting said electron source or a first substrate formed with said electron source and said image forming member or a second substrate formed with said image forming member.

13. An electron beam apparatus comprising:

an electron source;

a radiative member on which electrons emitted from said electron source are radiated; and a third member provided between said electron source and said radiative member, said third member comprising an electroconductive first member and a second member formed on said first member to partially expose said first member, wherein a conductivity of said second member is lower than a conductivity of said first member.

14. An electron beam apparatus according to claim 13, wherein said third member is a support member for supporting said electron source or a first substrate formed with said electron source and said radiative member or a second substrate formed with said radiative member.

15. An image forming apparatus comprising:

an electron source;

an image forming member for forming an image based on electrons emitted from said electron source; and a third member provided between said electron source and said image forming member, said third member comprising an electroconductive first member and a second member formed on said first member to partially expose said first member, wherein a conductivity of said second member is lower than a conductivity of said first member.

16. An image forming apparatus according to claim 15, wherein said third member is a support member for supporting said electron source or a first substrate formed with said electron source and said image forming member or a second substrate formed with said image forming member.

* * * * *

UNITED STATES PATENT AND TRADEMARK OFFICE

CERTIFICATE OF CORRECTION

PATENT NO. : 6,366,014 B1
DATED : April 2, 2002
INVENTOR(S) : Kazuo Kuroda et al.

It is certified that error appears in the above-identified patent and that said Letters Patent is hereby corrected as shown below:

Column 1,
Line 36, “Ditter” should read -- Dittmer --.
Line 39, “ARAKI” should read -- Araki --.
Line 54, “shape and position” should read -- shapes and positions --.

Signed and Sealed this

Thirtieth Day of July, 2002

*Attest:*

*Attesting Officer*

JAMES E. ROGAN
*Director of the United States Patent and Trademark Office*